US011476037B2

(12) United States Patent
Kim et al.

(10) Patent No.: US 11,476,037 B2
(45) Date of Patent: Oct. 18, 2022

(54) POWER INDUCTOR

(71) Applicant: MODA-INNOCHIPS CO., LTD., Ansan-Si (KR)

(72) Inventors: Gyeong Tae Kim, Ansan-Si (KR); Tae Geun Seo, Osan-Si (KR); Sang Jun Park, Hwaseong-Si (KR)

(73) Assignee: MODA-INNOCHIPS CO., LTD.

( * ) Notice: Subject to any disclaimer, the term of this patent is extended or adjusted under 35 U.S.C. 154(b) by 445 days.

(21) Appl. No.: 16/326,185

(22) PCT Filed: Aug. 30, 2017

(86) PCT No.: PCT/KR2017/009460
§ 371 (c)(1),
(2) Date: Feb. 15, 2019

(87) PCT Pub. No.: WO2018/048135
PCT Pub. Date: Mar. 15, 2018

(65) Prior Publication Data

US 2019/0189338 A1 Jun. 20, 2019

(30) Foreign Application Priority Data

Sep. 8, 2016 (KR) ..... 10-2016-0115770
Jun. 13, 2017 (KR) ..... 10-2017-0074170
Aug. 25, 2017 (KR) ..... 10-2017-0107780

(51) Int. Cl.
*H01F 27/28* (2006.01)
*H01F 27/29* (2006.01)
(Continued)

(52) U.S. Cl.
CPC ..... *H01F 27/29* (2013.01); *H01F 17/0013* (2013.01); *H01F 17/04* (2013.01);
(Continued)

(58) Field of Classification Search
CPC .... H01F 27/29; H01F 27/324; H01F 17/0013; H01F 17/04; H01F 27/022; H01F 27/255;
(Continued)

(56) References Cited

U.S. PATENT DOCUMENTS 5,750,264 A * 5/1998 Ueno ..... C04B 35/47 428/426
2004/0150500 A1* 8/2004 Kiko ..... H01F 17/043 336/90
(Continued)

FOREIGN PATENT DOCUMENTS

CN 104347262 A 2/2015
EP 3382722 A1 10/2018
(Continued)

OTHER PUBLICATIONS

International Search Report for PCT/KR2017/009460 dated Nov. 28, 2017.
(Continued)

*Primary Examiner* — Mang Tin Bik Lian
(74) *Attorney, Agent, or Firm* — Renaissance IP Law Group LLP

(57) ABSTRACT

Provided is a power inductor. The power inductor includes a body including metal powder and an insulation material, at least one base provided in the body, at least one coil pattern disposed on at least one surface of the base, and an external electrode disposed on each of at least two side surfaces of the body. At least a portion of the external electrode is made of the same material as the coil pattern.

13 Claims, 16 Drawing Sheets

(51) Int. Cl.

| | |
|---|---|
| ***H01F 27/32*** | (2006.01) |
| ***H01F 17/00*** | (2006.01) |
| ***H01F 17/04*** | (2006.01) |
| ***H01F 27/02*** | (2006.01) |
| ***H01F 27/255*** | (2006.01) |
| ***H01F 41/04*** | (2006.01) |
| *H01F 27/22* | (2006.01) |

(52) U.S. Cl.
CPC ..... *H01F 27/022* (2013.01); *H01F 27/255* (2013.01); *H01F 27/2804* (2013.01); *H01F 27/2828* (2013.01); *H01F 27/324* (2013.01); *H01F 41/04* (2013.01); *H01F 27/22* (2013.01); *H01F 2017/048* (2013.01)

(58) Field of Classification Search
CPC .. H01F 27/2804; H01F 27/2828; H01F 41/04; H01F 27/22; H01F 2017/048; H01F 27/025; H01F 27/32; H01F 2017/002
See application file for complete search history.

(56) References Cited

U.S. PATENT DOCUMENTS

| | | | | |
|---|---|---|---|---|
| 2004/0240146 | A1 | 12/2004 | Kayatani et al. | |
| 2007/0030113 | A1 | 2/2007 | Song et al. | |
| 2007/0181965 | A1* | 8/2007 | Ohmi | H01F 41/046 257/499 |
| 2013/0154058 | A1* | 6/2013 | Boday | H01L 23/295 257/536 |
| 2014/0145816 | A1* | 5/2014 | Sato | H01F 17/0013 336/208 |
| 2014/0285305 | A1* | 9/2014 | Yoo | H01F 27/022 336/200 |
| 2014/0292462 | A1 | 10/2014 | Lee | |
| 2015/0035640 | A1* | 2/2015 | Wang | H01F 27/2804 336/200 |
| 2015/0170823 | A1* | 6/2015 | Jeong | H01F 17/0013 336/200 |
| 2016/0071643 | A1 | 3/2016 | Heo et al. | |
| 2016/0141093 | A1 | 5/2016 | Jeong | |
| 2016/0155550 | A1* | 6/2016 | Oh | H01F 1/24 336/233 |
| 2016/0155556 | A1* | 6/2016 | Oh | H01F 27/292 336/83 |
| 2016/0163444 | A1 | 6/2016 | Choi et al. | |
| 2016/0225517 | A1 | 8/2016 | Choi | |
| 2016/0268038 | A1* | 9/2016 | Choi | H01F 27/255 |

FOREIGN PATENT DOCUMENTS

| | | | |
|---|---|---|---|
| EP | 3489973 | A1 | 5/2019 |
| JP | H05251852 | A | 9/1993 |
| JP | H09148135 | A | 6/1997 |
| JP | H11345734 | A | 12/1999 |
| JP | 2006278909 | A | 10/2006 |
| JP | 2007049142 | A | 2/2007 |
| JP | 2007266105 | A | 10/2007 |
| JP | 2013254917 | A | 12/2013 |
| JP | 2014080674 | A | 5/2014 |
| JP | 2015204337 | A | 11/2015 |
| JP | 2015228477 | A | 12/2015 |
| JP | 2015228479 | A | 12/2015 |
| KR | 940016309 | A | 7/1994 |
| KR | 20070032259 | A | 3/2007 |
| KR | 20140011693 | A | 1/2014 |
| KR | 20140077346 | A | 6/2014 |
| KR | 20140083579 | A | 7/2014 |
| KR | 20140131418 | A | 11/2014 |
| KR | 20150080800 | A | 7/2015 |
| KR | 20150108518 | A | 9/2015 |
| KR | 20160018382 | A | 2/2016 |
| KR | 20160019266 | A | 2/2016 |
| KR | 20160098780 | A | 8/2016 |
| TW | 201125003 | A | 7/2011 |
| TW | 201618135 | A | 5/2016 |
| WO | 2016021818 | A1 | 2/2016 |
| WO | 2016021938 | A1 | 2/2016 |

OTHER PUBLICATIONS

Written Opinion for PCT/KR2017/009460 dated Nov. 28, 2017.
Extended European Search Report for Application No. 17849019.9 dated Jan. 8, 2020.

* cited by examiner

POWER INDUCTOR

TECHNICAL FIELD

The present disclosure relates to a power inductor, and more particularly, to a power inductor that is capable of preventing short circuit from occurring with respect to peripheral devices and a method for manufacturing the same.

BACKGROUND

A power inductor is mainly provided in a power circuit such as a DC-DC converter within a portable device. The power inductor is increasing in use instead of an existing wire wound choke coil as the power circuit is switched at a high frequency and is miniaturized. Also, the power inductor is being developed in the manner of miniaturization, high current, low resistance, and the like as the portable device is reduced in size and multi-functionalized.

The power inductor in accordance with the related art is manufactured in a shape in which a plurality of ferrites or ceramic sheets made of a dielectric having a low dielectric constant are laminated. Here, a coil pattern is formed on each of the ceramic sheets, and thus, the coil pattern formed on each of the ceramic sheets is connected to the ceramic sheet by a conductive via, and the coil patterns overlap each other in a vertical direction in which the sheets are laminated. Also, in the related art, the body in which the ceramic sheets are laminated may be generally manufactured by using a magnetic material composed of a four element system of nickel (Ni), zinc (Zn), copper (Cu), and iron (Fe).

However, the magnetic material has a relatively low saturation magnetization value when compared to that of the metal material, and thus, the magnetic material may not realize high current properties that are required for the recent portable devices. As a result, since the body constituting the power inductor is manufactured by using metal powder, the power inductor may relatively increase in saturation magnetization value when compared to the body manufactured by using the magnetic material. However, if the body is manufactured by using the metal, an eddy current loss and a hysteresis loss at a high frequency wave may increase to cause serious damage of the material.

To reduce the loss of the material, a structure in which the metal powder is insulated from each other by a polymer may be applied. That is, sheets in which the metal powder and the polymer are mixed with each other are laminated to manufacture the body of the power inductor. Also, a predetermined base on which a coil pattern is formed is provided inside the body, and an external electrode connected to the coil pattern is formed outside the body. That is, the coil pattern is formed on the predetermined base, and a plurality of sheets are laminated and compressed on upper and lower sides of the coil pattern to manufacture the power inductor, and then, the external electrode is formed outside the body to manufacture the power inductor.

In the power inductor, the external electrode formed on the bottom surface of the body is mounted on a printed circuit board (PCB). Here, the power inductor is mounted adjacent to a power management IC (PMIC). The PMIC has a thickness of approximately 1 mm, and also, the power inductor may have the same thickness. The PMIC may generate high frequency noises to affect peripheral circuits or devices. Thus, the PMIC and the power inductor may be covered by a shield can that is made of a metal material such as stainless steel. However, since the external electrode of the power inductor extends to the bottom and top surfaces, the external electrode on the top surface of the power inductor may be short-circuited with the shield can.

The external electrode of the power inductor is formed by applying conductive paste. That is, metal paste may be applied to both side surfaces of the body so as to be connected to the coil pattern and thereby to form the external electrode. Also, a plated layer may be further formed on the metal paste to form the external electrode. However, the external electrode formed by using the metal paste may be separated from the body due to weak coupling force thereof. That is, tensile force may act on the power inductor mounted on the electronic device. Thus, in the power inductor on which the external electrode is formed by using the metal paste, the external electrode may be separated from the body due to the weak tensile strength.

RELATED ART DOCUMENT

Korean Patent Publication No. 2007-0032259

Technical Problem

The present disclosure also provides a power inductor that is capable of preventing an external electrode from being short-circuited.

The present disclosure also provides a power inductor that is capable of preventing an external electrode from being exposed to prevent the external electrode from being short-circuited with a shield can.

The present disclosure also provides a power inductor that is capable of improving tensile strength.

Technical Solution

In accordance with an exemplary embodiment, a power inductor includes: a body including metal powder and an insulation material; at least one base provided in the body; at least one coil pattern disposed on at least one surface of the base; and an external electrode disposed on each of at least two side surfaces of the body, wherein at least a portion of the external electrode includes the same material as the coil pattern.

Each of the coil pattern and the external electrode may include copper.

The coil pattern may be formed on the base through a plating process, and an area of the external electrode, which comes into contact with at least the coil pattern, may be formed through the plating process.

The external electrode may include a first layer coming into contact with the coil pattern and at least one second layer made of a material different from that of the first layer.

The metal powder may include at least one or more materials having at least two or more sizes.

The coil patterns disposed on one surface and the other surface of the base may have the same height, which is greater 2.5 times than a thickness of the base.

The power inductor may further include an internal insulation layer disposed between the coil pattern and the body and made of parylene.

The power inductor may further include a surface insulation layer disposed on at least one surface of the body.

The surface insulation layer may be disposed on that at least one surface of the body, on which the external electrode is not disposed.

The power inductor may further include a capping insulation layer on one surface of the body.

The capping insulation layer may be disposed on one surface facing the mounted surface of the body to prevent the extending external electrode disposed on the one surface from being exposed.

The capping insulation layer may have a thickness greater than or equal to that of the surface insulation layer.

Advantageous Effects

In the power inductor in accordance with the exemplary embodiments, the capping insulation may be formed on the top surface of the body to prevent the external electrode from being exposed, thereby preventing the external electrode, the shield can, and the adjacent components from being short-circuited therebetween.

Also, the external electrode connected to the coil pattern may be formed of the same material as the coil pattern and formed in the same manner as the coil pattern. That is, at least a portion of the external electrode, which comes into contact with the side surface of the body and is connected to the coil pattern, may be formed by using the same material as the coil pattern and in the same manner as the coil pattern, for example, in the copper plating manner. Thus, the coupling force between the body and the external electrode may be improved, and thus, the tensile strength may be improved.

Also, since the parylene is applied on the coil pattern, the parylene having the uniform thickness may be formed on the coil pattern, and thus, the insulation between the body and the coil pattern may be improved.

Also, the at least two bases each of which has at least one surface on which the coil pattern having the coil shape is disposed may be provided in the body to form the plurality of coils within one body, thereby increasing in capacity of the power inductor.

DETAILED DESCRIPTION

Hereinafter, specific embodiments will be described in detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art.

Figure 1:
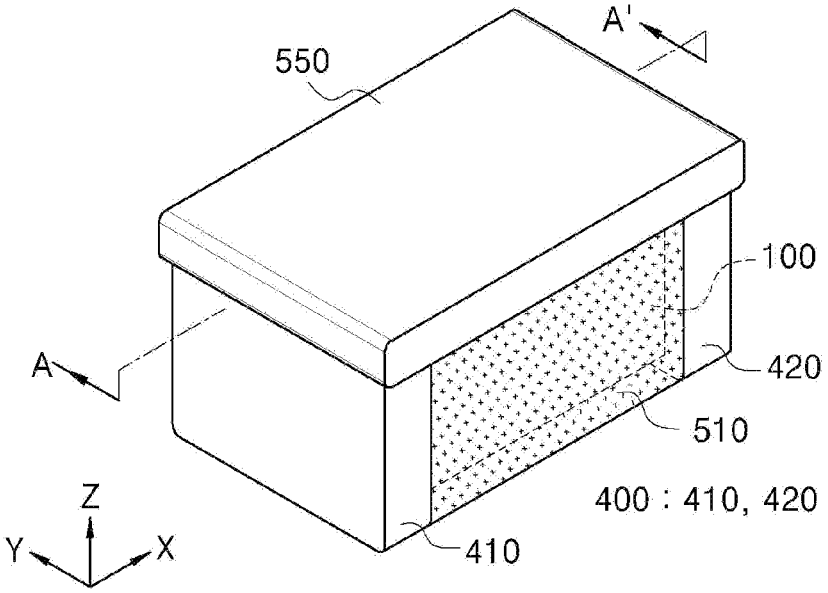
FIG. 1 is a combined perspective view of a power inductor in accordance with an exemplary embodiment.
Figure 2:
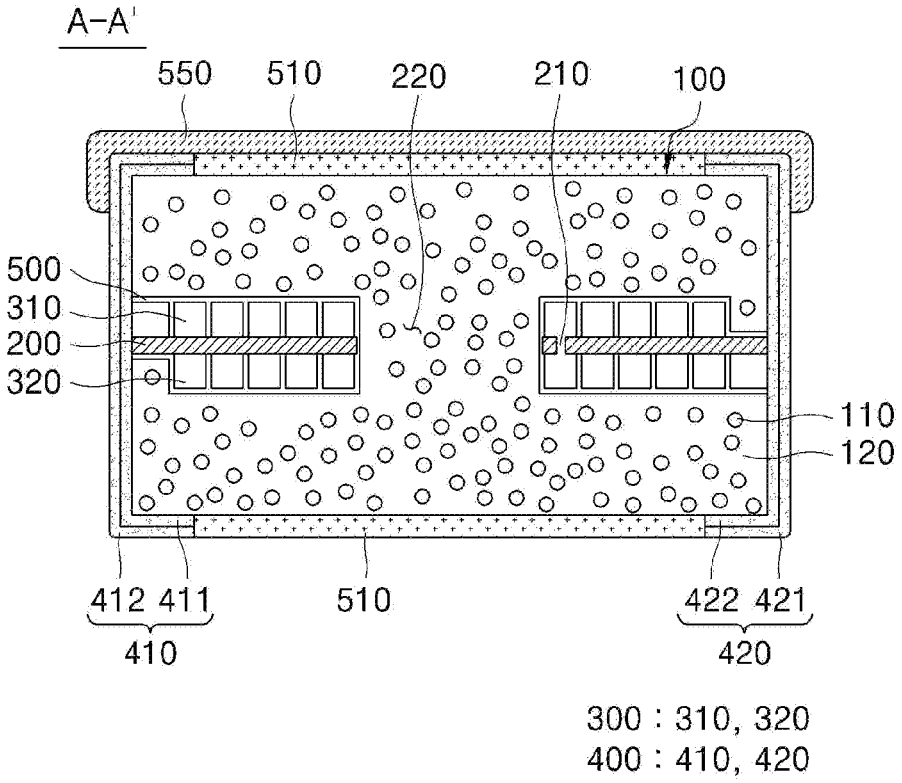
FIGS. 2 and 3 are cross-sectional views taken along line A-A' of FIG. 1 in accordance with modified examples of an exemplary embodiment.
Figure 3:
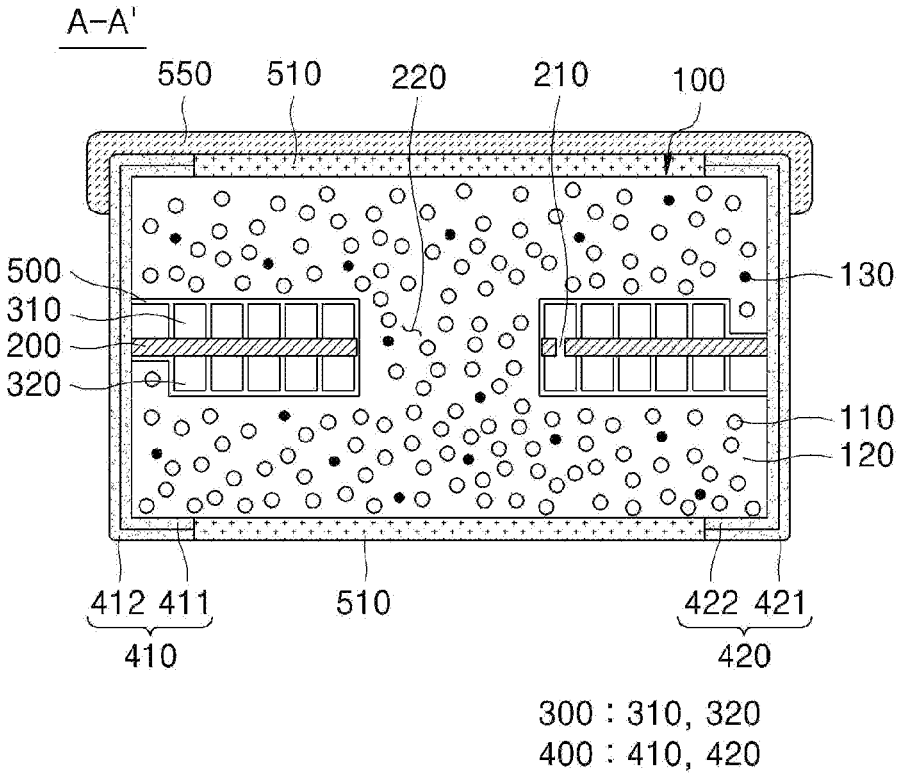
Figure 4:
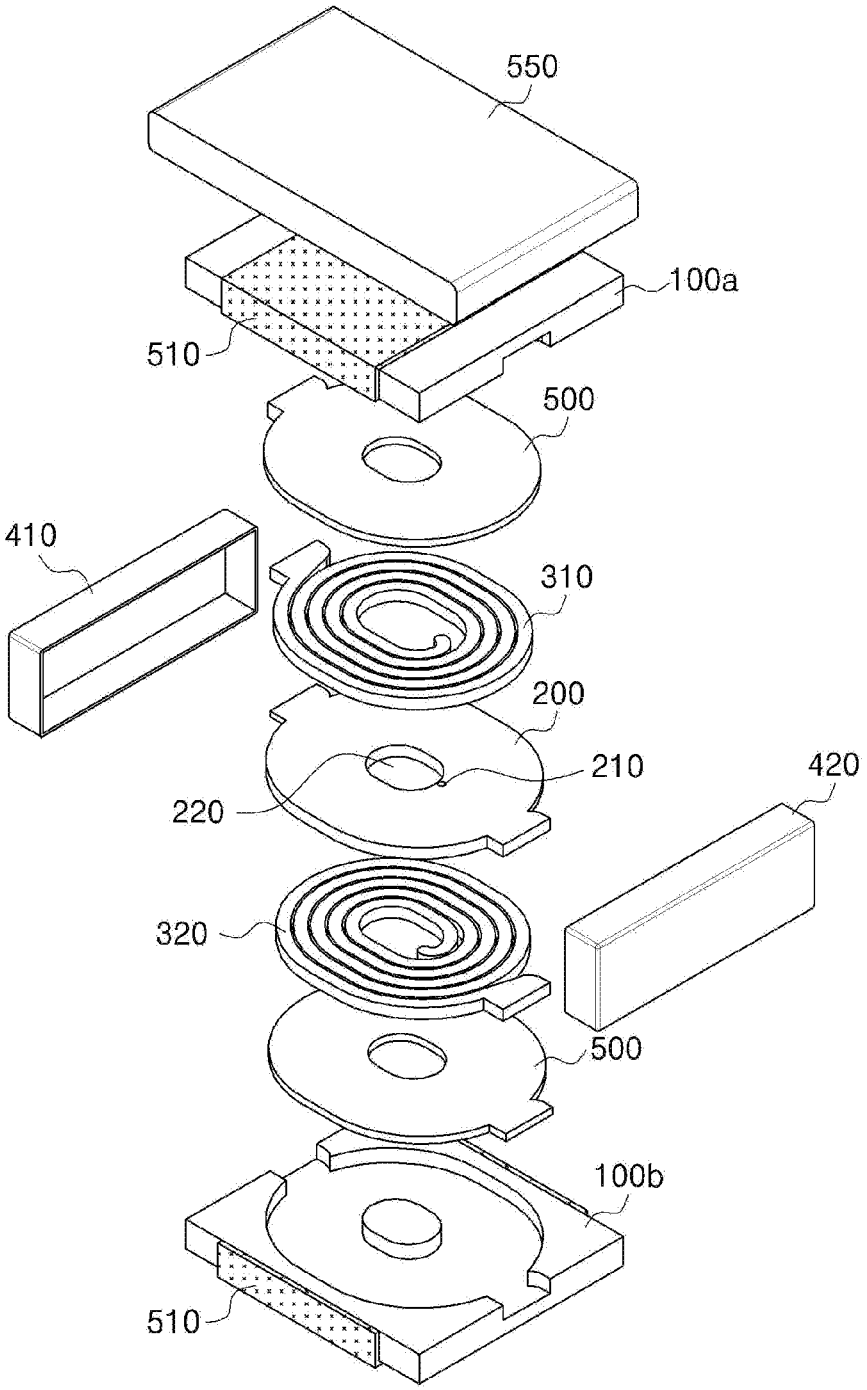
FIGS. 4 and 5 are exploded perspective views and a partial plan view of the power inductor in accordance with an exemplary embodiment.
Figure 5:
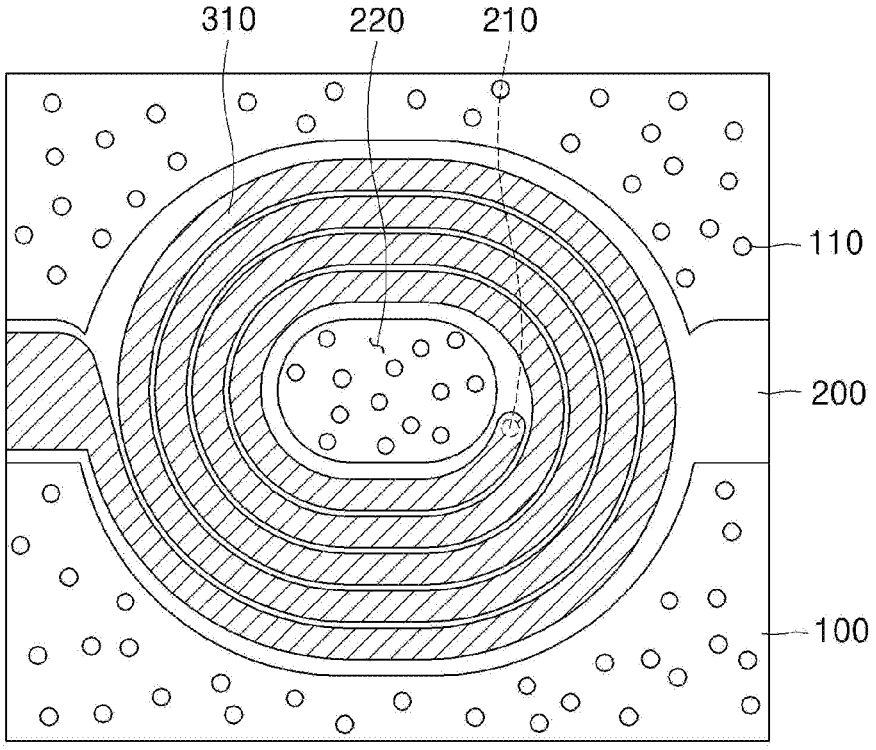
Figure 6:
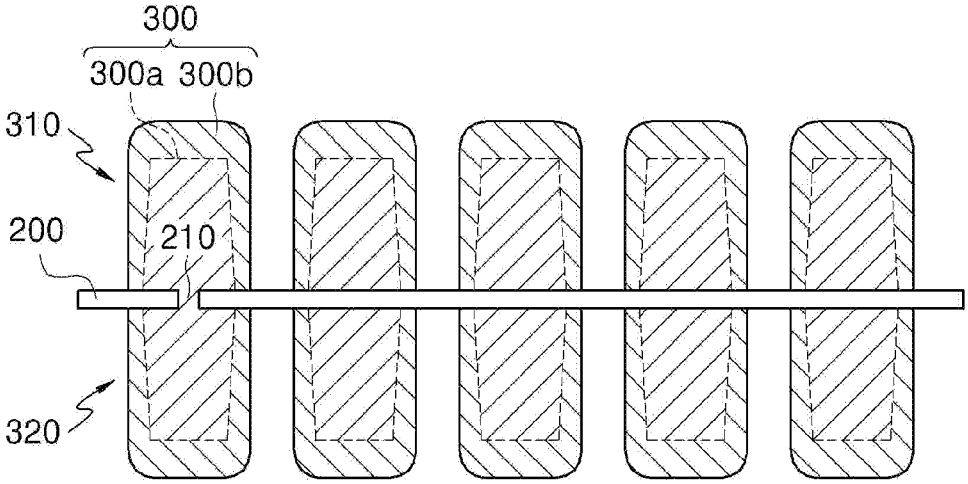
FIGS. 6 and 7 are cross-sectional views illustrating a coil pattern within the power inductor in accordance with an exemplary embodiment.
Figure 7:
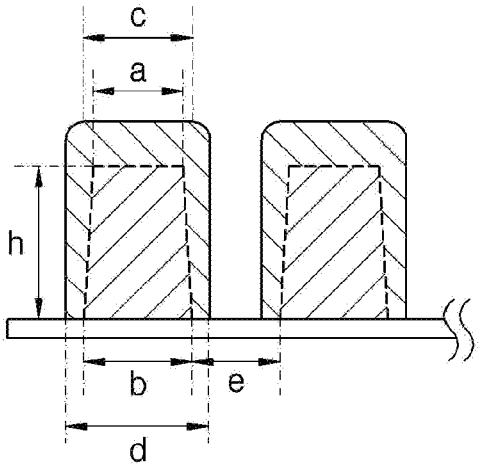
Figure 8:
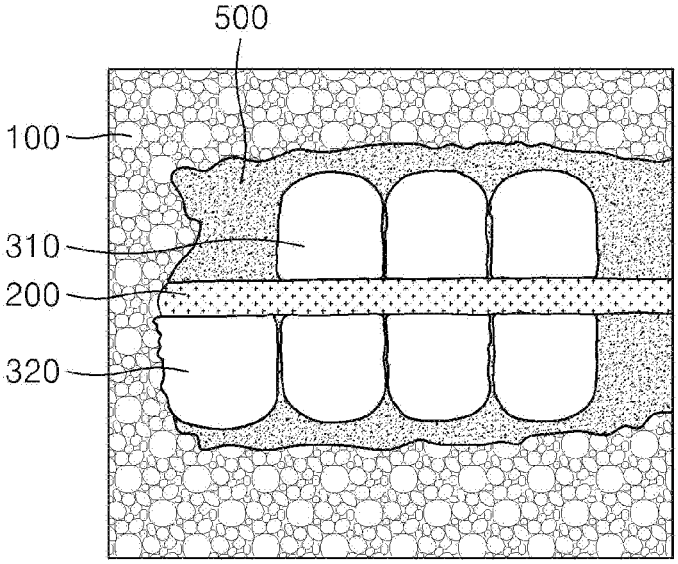
FIGS. 8 and 9 are cross-sectional photographs of the power inductor depending on materials of an insulation layer.
Figure 9:
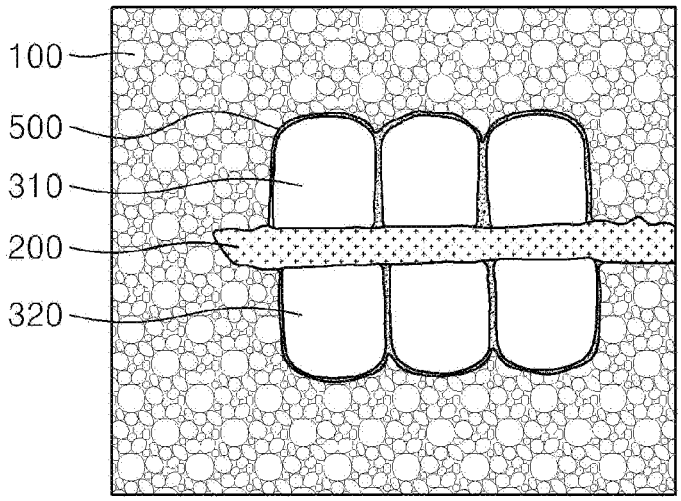
Figure 10:
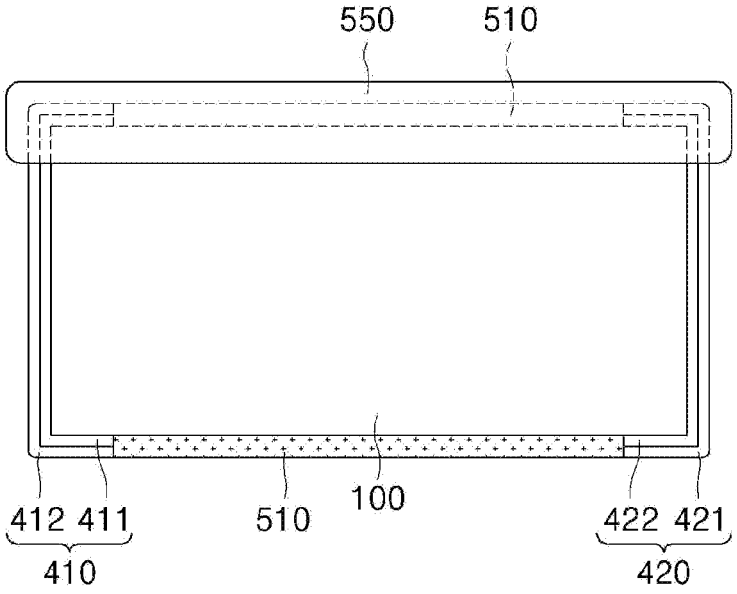
FIG. 10 is a side view of the power inductor in accordance with an exemplary embodiment.

FIG. 1 is a combined perspective view of a power inductor in accordance with an exemplary embodiment, and FIGS. 2 and 3 are cross-sectional views taken along line A-A' of FIG. 1 in accordance with modified examples of an exemplary embodiment. FIG. 4 is an exploded perspective view of the power inductor in accordance with an exemplary embodiment, FIG. 5 is a plan view of a base and a coil pattern, and FIGS. 6 and 7 are cross-sectional views illustrating the coil pattern within the power inductor in accordance with an exemplary embodiment. FIGS. 8 and 9 are cross-sectional photographs of the power inductor depending on materials of an insulation layer, and FIG. 10 is a side view of the power inductor.

Referring to FIGS. 1 to 10, a power inductor in accordance with an exemplary embodiment may include a body 100 (100*a* and 100*b*), a base 200 provided in the body 100, a coil pattern 300 (310 and 320) disposed on at least one surface of the base 200, and an external electrode 400 (410 and 420) disposed outside the body 100. Also, the power inductor may further include at least one of an internal insulation layer 500 disposed between the coil pattern 300 (310 and 320) and the body 100, a surface insulation layer 510 disposed on a surface of the body 100, on which the external electrode 400 is not disposed, and a capping insulation layer 550 disposed on at least a top surface of the body on which the external electrode 400 is disposed.

1. Body

The body 100 may have a hexahedral shape. Of course, the body 100 may have a polyhedral shape in addition to the hexahedral shape. The body 100 may include metal powder 110 and an insulation material 120 as illustrated in FIG. 2 and may further include a thermal conductive filler 130 as illustrated in FIG. 3.

The metal powder 110 may have a mean particle diameter of 1 μm to 100 μm. Also, one kind of powder having the same size or at least two kinds of powder may be used as the metal powder 110, or one kind of powder having a plurality of sizes or at least two kinds of powder may be used as the metal powder 110. For example, first metal powder having a mean particle diameter of 20 μm to 100 μm, second metal powder having a mean particle diameter of 2 μm to 20 μm, and third metal powder having a mean particle diameter of 1 μm to 10 μm may be mixed with each other to be used as the metal powder 110. That is, the metal powder 110 may include the first metal powder of which a mean value of particle sizes or a middle value D50 of grain-size distribution ranges from 20 μm to 100 μm, second metal powder of which a mean value of particle sizes or a middle value D50 of grain-size distribution ranges from 2 μm to 20 μm, and third metal powder of which a mean value of particle sizes or a middle value D50 of grain-size distribution ranges from 1 μm to 10 μm. Here, the first metal powder may have a particle size greater than that of the second metal powder, and the second metal powder may have a particle size greater than that of the third metal powder. Here, the metal powder may be powder made of the same material or powder made of materials different from each other. Also, a mixing ratio of the first, second, and third metal powder may be 5 to 9:0.5 to 2.5:0.5 to 2.5, preferably, 7:1:2. That is, 50 wt % to 90 wt % of the first metal powder, 5 wt % to 25 wt % of the second metal powder, and 5 wt % to 25 wt % of the third metal powder with respect to 100 wt % of the metal powder 110 may be mixed. Here, an amount of first metal powder may be greater than that of second metal powder, and an amount of second metal powder may be less than or equal to that of third metal powder. Preferably, 70 wt % of the first metal powder, 10 wt % of the second metal powder, and 20 wt % of the third metal powder with respect to 100 wt % of the metal powder 110 may be mixed. The metal powder 110 having at least two or more, preferably, three or more mean particle sizes may be uniformly mixed and distributed in the entirety of the body 100, and thus the entire body 100 may have uniform magnetic permeability. When the at least two or more kinds of metal powder 110 having sizes different from each other are used, the body 100 may increase in filling rate and thus be maximized in capacity. For example, in case of using the metal powder having the mean size of 30 μm, a pore may be generated between the metal powder, and thus, the filling rate may be reduced. However, the metal powder having the size of 3 μm may be mixed between the metal powder having the size of 30 μm to increase the filling rate of the metal powder within the body 110. The metal powder 110 may use a metal material including iron (Fe), for example, may include at least one metal selected from the group consisting of Fe—Ni, Fe-Ni—Si, Fe—Al—Si, and Fe—Al—Cr. That is, the metal powder 110 may include iron to have a magnetic tissue or be formed of a metal alloy having magnetic properties to have predetermined magnetic permeability. Also, a surface of the metal powder 110 may be coated with a magnetic material, and the magnetic material may have magnetic permeability different from that of the metal powder 110. For example, the magnetic material may include a metal oxide magnetic material. The metal oxide magnetic material may include at least one selected from the group consisting of a Ni oxide magnetic material, a Zn oxide magnetic material, a Cu oxide magnetic material, a Mn oxide magnetic material, a Co oxide magnetic material, a Ba oxide magnetic material, and a Ni—Zn—Cu oxide magnetic material. That is, the magnetic material applied to the surface of the metal powder 110 may include metal oxide including iron and have magnetic permeability greater than that of the metal powder 110. Since the metal powder 110 has magnetism, when the metal powder 110 come into contact with each other, the insulation therebetween may be broken to cause short-circuit. Thus, the surface of the metal powder 110 may be coated with at least one insulation material. For example, the surface of the metal powder 110 may be coated with oxide or an insulative polymer material such as parylene, preferably, the surface of the metal powder 110 may be coated with the parylene. The parylene may be coated to a thickness of 1 μm to 10 μm. Here, when the parylene is formed to a thickness of 1 μm or less, an insulation effect of the metal powder 110 may be deteriorated. When the parylene is formed to a thickness exceeding 10 μm, the metal powder 110 may increase in size to reduce distribution of the metal powder 110 within the body 100, thereby deteriorating the magnetic permeability. Also, the surface of the metal powder 110 may be coated with various insulative polymer materials in addition to the parylene. The oxide applied to the metal powder 110 may be formed by oxidizing the metal powder 110, and the metal powder 110 may be coated with at least one selected from $TiO_2$, $SiO_2$, $ZrO_2$, $SnO_2$, NiO, ZnO, CuO, CoO, MnO, MgO, $Al_2O_3$, $Cr_2O_3$, $Fe_2O_3$, $B_2O_3$, and $Bi_2O_3$. Here, the metal powder 110 may be coated with oxide having a double structure, for example, may be coated with a double structure of the oxide and the polymer material. Alternatively, the surface of the metal powder 110 may be coated with an insulation material after being coated with the magnetic material. Since the surface of the metal powder 110 is coated with the insulation material, the short circuit due to the contact between the metal powder 110 may be prevented. Here, when the metal powder 100 is coated with the oxide and the insulation polymer or doubly coated with the magnetic material and the insulation material, the coating material may be coated to a thickness of 1 μm to 10 μm.

The insulation material 120 may be mixed with the metal powder 110 to insulate the metal powder 110 from each other. That is, the metal powder 110 may increase in eddy current loss and hysterical loss at a high frequency to cause a problem in which a material loss increases, and thus, to reduce the material loss, the insulation material 120 may be provided to insulate the metal powder 110 from each other. The insulation material 120 may include at least one selected from the group consisting of epoxy, polyimide, and liquid crystalline polymer (LCP), but is not limited thereto. Also, the insulation material 120 may be disposed between the metal powder 110 and be made of a thermosetting resin. For example, the thermosetting resin may include at least one selected from the group consisting of a novolac epoxy resin, a phenoxy type epoxy resin, a BPA type epoxy resin, a BPF type epoxy resin, a hydrogenated BPA epoxy resin, a dimer acid modified epoxy resin, a urethane modified epoxy resin, a rubber modified epoxy resin, and a DCPD type epoxy resin. Here, the insulation material 120 may be contained at a content of 2.0 wt % to 5.0 wt % with respect to 100 wt % of the metal powder 110. However, if the content of the insulation material 120 increases, a volume fraction of the metal powder 110 may be reduced, and thus, it is difficult to properly realize an effect in which a saturation magnetization value increases. Thus, the magnetic permeability of the body 100 may be deteriorated. On the other hand, if the content of the insulation material 120 decreases, a strong acid solution or a strong alkali solution that is used in a process of manufacturing the inductor may be permeated inward to reduce inductance properties. Thus, the insulation material 120 may be contained within a range in which the saturation magnetization value and the inductance of the metal powder 110 are not reduced.

However, there is a problem in which the power inductor manufactured by using the metal powder 110 and the insulation material 120 is reduced in inductance due to an increase of a temperature. That is, the power inductor may increase in temperature by generation of heat of the electronic device to which the power inductor is applied, and thus, the metal powder 110 forming the body of the power inductor may be heated to cause the problem in which the inductance is reduced. To solve this problem, the body 100 may include a thermal conductive filler 130 to solve the limitation in which the body 100 is heated by external heat. That is, the metal powder 110 of the body 100 may be heated by external heat, and thus, the thermal conductive filler 130 may be provided to easily release the heat of the metal powder 110 to the outside. The thermal conductive filler 130 may include at least one selected from the group consisting of MgO, AlN, carbon-based materials, Ni-based ferrite, and Mn-based ferrite, but is not limited thereto. Here, the carbon-based material may include carbon and have various shapes, for example, may include graphite, carbon black, graphene, and the like. Also, the Ni-based ferrite may include NiO.ZnO.CuO—$Fe_2O_3$, and the Mn-based ferrite may include MnO.ZnO.CuO—$Fe_2O_3$. Here, the thermal conductive filler may be made of a ferrite material to improve the magnetic permeability or prevent the magnetic permeability from being deteriorated. The thermal conductive filler 130 may be dispersed and contained in the insulation material 120 in the form of powder. Also, the thermal conductive filler 130 may be contained at a content of 0.5 wt % to 3 wt % with respect to 100 wt % of the metal powder 110. When the thermal conductive filler 130 has a content less than the above-described range, it may be difficult to obtain a heat releasing effect. On the other hand, when the thermal conductive filler 130 has a content exceeding the above-described range, a content of the metal powder 110 may be reduced to deteriorate the magnetic permeability of the body 100. Also, the thermal conductive filler 130 may have a size of, for example, 0.5 μm to 100 μm. That is, the thermal conductive filler 130 may have the same size as metal powder 110 or a size greater or less than that of the metal powder 110. The heat releasing effect may be adjusted in accordance with a size and content of the thermal conductive filler 130. For example, the more the size and content of the thermal conductive filler 130 increase, the more the heat releasing effect may increase. The body 100 may be manufactured by laminating a plurality of sheets, which are made of a material including the metal powder 110, the insulation material 120, and the thermal conductive filler 130. Here, when the plurality of sheets are laminated to manufacture the body 100, the thermal conductive fillers 130 of the sheets may have contents different from each other. For example, the more the thermal conductive filler 130 is gradually away upward and downward from the center of the base 200, the more the content of the thermal conductive filler 130 within the sheet may gradually increase. That is, the content of the thermal conductive filler 130 may vary in a vertical direction, i.e., in a Z direction. Also, the thermal conductive filler 130 may vary in a horizontal direction, i.e., in at least one direction of an X direction and a Y direction. That is, a content of the thermal conductive filer 130 with the same sheet may vary. Also, the body 100 may be manufactured by various methods such as a method of printing of paste, which is made of the metal powder 110, the insulation material 120, and the thermal conductive filler 130, at a predetermined thickness and a method of pressing the paste into a frame. Here, the number of laminated sheet or the thickness of the paste printed to the predetermined thickness so as to form the body 100 may be determined in consideration of electrical characteristics such as an inductance required for the power inductor. Although a modified example in which the body 100 further includes the thermal conductive filler is described, it should be understood that the body 100 may further include the thermal conductive filler even though the thermal conductive filler is not mentioned in the following description in accordance with another exemplary embodiment.

Also, the body 100 (100*a* and 100*b*) disposed on the upper and lower portions of the base 200 with the base 200 therebetween may be connected to each other through the base 200. That is, at least a portion of the base 200 may be removed, and then a portion of the body 100 may be filled into the removed portion of the base 200. Since at least a portion of the base 200 is removed, and the body 100 is filled into the removed portion, the base 200 may be reduced in surface area, and a rate of the body 100 in the same volume may increase to improve the magnetic permeability of the power inductor.

2. Base

The base 200 may be provided in the body 100. For example, the base 200 may be provided in the body 100 in a long axis direction of the body 100, i.e., a direction of the external electrode 400. Also, one or more bases 200 may be provided. For example, two or more bases 200 may be spaced a predetermined distance from each other in a direction perpendicular to a direction in which the external electrode 400 is disposed, for example, in a vertical direction. Of course, two or more bases 200 may be arranged in the direction in which the external electrode 400 is disposed. For example, the base 200 may be manufactured by using copper clad lamination (CCL) or metal magnetic body. Here, the base 200 may be manufactured by using the metal magnetic body to improve the magnetic permeability and facilitate capacity realization. That is, the CCL is manufactured by bonding copper foil to a glass reinforced fiber. Since the CCL has the magnetic permeability, the power inductor may be deteriorated in magnetic permeability. However, when the metal magnetic body is used as the base 200, since the metal magnetic body has the magnetic permeability, the power inductor may not be deteriorated in magnetic permeability. The base 200 using the metal magnetic body may be manufactured by bonding copper foil to a plate having a predetermined thickness, which is made of a metal containing iron, e.g., at least one metal selected from the group consisting of Fe-Ni, Fe-Ni—Si, Fe—Al—Si, and Fe—Al—Cr. That is, an alloy made of at least one metal containing iron may be manufactured in a plate shape having a predetermined thickness, and copper foil may be bonded to at least one surface of the metal plate to manufacture the base 200.

Also, at least one conductive via 210 may be defined in a predetermined area of the base 200. The coil patterns 310 and 320 disposed on the upper and lower portions of the base 200 may be electrically connected to each other through the conductive via 210. A via (not shown) passing through the base 200 in a thickness direction of the base 200 may be formed in the base 200, and then the paste may be filled into the via to form the conductive via 210. Here, at least one of the coil patterns 310 and 320 may be grown from the conductive via 210, and thus, at least one of the coil patterns 310 and 320 may be integrated with the conductive via 210. Also, at least a portion of the base 200 may be removed. That is, at least a portion of the base 200 may be removed or may not be removed. As illustrated in FIGS. 4 and 5, an area of the base 200, which remains except for an area overlapping the coil patterns 310 and 320, may be removed. For example, the base 200 may be removed to form the through-hole 220 inside the coil patterns 310 and 320 each of which has a spiral shape, and the base 200 outside the coil patterns 310 and 320 may be removed. That is, the base 200 may have a shape along an outer appearance of each of the coil patterns 310 and 320, e.g., a racetrack shape, and an area of the base 200 facing the external electrode 400 may have a linear shape along a shape of an end of each of the coil patterns 310 and 320. Thus, the outside of the base 200 may have a shape that is curved with respect to an edge of the body 100. As illustrated in FIG. 5, the body 100 may be filled into the removed portion of the base 200. That is, the upper and lower bodies 100*a* and 100*b* may be connected to each other through the removed region including the through-hole 220 of the base 200. When the base 200 is manufactured using the metal magnetic material, the base 200 may contact the metal powder 110 of the body 100. To solve the above-described limitation, the internal insulation layer 500 such as parylene may be disposed on a side surface of the base 200. For example, the internal insulation layer 500 may be disposed on a side surface of the through-hole 220 and an outer surface of the base 200. The base 200 may have a width greater than that of each of the coil patterns 310 and 320. For example, the base 200 may remain with a predetermined width in a directly downward direction of the coil patterns 310 and 320. For example, the base 200 may protrude by a height of about 0.3 μm from each of the coil patterns 310 and 320. Since the base 200 outside and inside the coil patterns 310 and 320 is removed, the base 200 may have a cross-sectional area less than that of the body 100. For example, when the cross-sectional area of the body 100 is defined as a value of 100, the base 200 may have an area ratio of 40 to 80. If the area ratio of the base 200 is high, the magnetic permeability of the body 100 may be reduced. On the other hand, if the area ratio of the base 200 is low, the formation area of the coil patterns 310 and 320 may be reduced. Thus, the area ratio of the base 200 may be adjusted in consideration of the magnetic permeability of the body 100 and a line width and turn number of each of the coil patterns 310 and 320.

3. Coil Pattern

The coil patterns 300 (310 and 320) may be disposed on at least one surface, preferably, both surfaces of the base 200. Each of the coil patterns 310 and 320 may be formed in a spiral shape on a predetermined area of the base 200, e.g., outward from a central portion of the base 200, and the two coil patterns 310 and 320 disposed on the base 200 may be connected to each other to form one coil. That is, each of the coil patterns 310 and 320 may have a spiral shape from the outside of the through-hole 220 defined in the central portion of the base 200. Also, the coil patterns 310 and 320 may be connected to each other through the conductive via 210 provided in the base 200. Here, the upper coil pattern 310 and the lower coil pattern 320 may have the same shape and the same height. Also, the coil patterns 310 and 320 may overlap each other. Alternatively, the coil pattern 320 may be disposed to overlap an area on which the coil pattern 310 is not disposed. An end of each of the coil patterns 310 and 320 may extend outward in a linear shape and also extend along a central portion of a short side of the body 100. Also, an area of each of the coil patterns 310 and 320 contacting the external electrode 400 may have a width greater than that of the other area as illustrated in FIGS. 4 and 5. Since a portion of each of the coil patterns 310 and 320, i.e., a lead-out part has a relatively wide width, a contact area between each of the coil patterns 310 and 320 and the external electrode 400 may increase to reduce resistance. Alternatively, each of the coil patterns 310 and 320 may extend in a width direction of the external electrode 400 from one area on which the external electrode 400 is disposed. Here, the lead-out part that is led out toward a distal end of each of the coil patterns 310 and 320, i.e., the external electrode 400 may have a linear shape toward a central portion of the side surface of the body 100.

The coil patterns 310 and 320 may be electrically connected to each other by the conductive via 210 provided in the base 200. The coil patterns 310 and 320 may be formed through methods such as, for example, thick-film printing, coating, deposition, plating, and sputtering. Here, the coil patterns 310 and 320 may preferably formed through the plating. Also, each of the coil patterns 310 and 320 and the conductive via 210 may be made of a material including at least one of silver (Ag), copper (Cu), and a copper alloy, but is not limited thereto. When the coil patterns 310 and 320 are formed through the plating process, a metal layer, e.g., a cupper layer is formed on the base 200 through the plating process and then patterned through a lithography process. That is, the copper layer may be formed by using the copper foil disposed on the surface of the base 200 as a seed layer and then patterned to form the coil patterns 310 and 320. Alternatively, a photosensitive pattern having a predetermined shape may be formed on the base 200, and the plating process may be performed to grow a metal layer from the exposed surface of the base 200, thereby forming the coil patterns 310 and 320, each of which has a predetermined shape. The coil patterns 310 and 320 may be formed with a multilayer structure. That is, a plurality of coil patterns 310 and 320 may be further disposed above the coil pattern 310 disposed on the upper portion of the base 200, and a plurality of coil patterns may be further disposed below the coil pattern 320 disposed on the lower portion of the base 200. When the coil patterns 310 and 320 are formed with the multilayer structure, the insulation layer may be disposed between a lower layer and an upper layer. Then, the conductive via (not shown) may be formed in the insulation layer to connect the multilayered coil patterns to each other. Each of the coil patterns 310 and 320 may have a height that is greater 2.5 times than a thickness of the base 200. For example, the base may have a thickness of 10 μm to 50 μm, and each of the coil patterns 310 and 320 may have a height of 50 μm to 300 μm.

Also, the coil patterns 310 and 320 in accordance with an exemplary embodiment may have a double structure. That is, as illustrated in FIG. 6, a first plated layer 300*a* and a second plated layer 300*b* configured to cover the first plated layer 300*a* may be provided. Here, the second plated layer 300*b* may be disposed to cover top and side surfaces of the first plated layer 300*a*. Also, the second plated layer 300*b* may be formed so that the top surface of the first plated layer 300*a* has a thickness greater than that of the side surface of the first plated layer 300*a*. The side surface of the first plated layer 300*a* may have a predetermined inclination, and a side surface of the second plated layer 300*b* may have an inclination less than that of the side surface of the first plated layer 300*a*. That is, the side surface of the first plated layer 300*a* may have an obtuse angle from the surface of the base 200 outside the first plated layer 300*a*, and the second plated layer 300*b* has an angle less than that of the first plated layer 300*a*, preferably, a right angle. As illustrated in FIG. 7, a ratio of a width a of a top surface to a width b of a bottom surface of the first plated layer 300*a* may be 0.2:1 to 0.9:1, preferably, a ratio of a:b may be 0.4:1 to 0.8:1. Also, a ratio of a width b to a height h of the bottom surface of the first plated layer 300*a* may be 1:0.7 to 1:4, preferably, 1:1 to 1:2. That is, the first plated layer 300*a* may have a width that gradually decreases from the bottom surface to the top surface. Thus, the first plated layer 300*a* may have a predetermined inclination. An etching process may be performed after a primary plating process so that the first plated layer 300*a* has a predetermined inclination. Also, the second plated layer 300*b* configured to cover the first plated layer 300*a* may have an approximately rectangular shape in which a side surface is vertical, and an area rounded between the top surface and the side surface is less. Here, the second plated layer 300*b* may be determined in shape in accordance with a ratio between the width a of the top surface and the width b of the bottom surface of the first plated layer 300*a*, i.e., a ratio of a:b. For example, the more the ratio (a:b) of the width a of the top surface to the width b of the bottom surface of the first plated layer 300*a* increases, the more a ratio of a width c of the top surface to a width d of the bottom surface of the second plated layer 300*b* increases. However, when the ratio (a:b) of the width a of the top surface to the width b of the bottom surface of the first plated layer 300*a* exceeds 0.9:1, the width of the top surface of the second plated layer 300*b* may be more widened than that of the top surface of the second plated layer 300*b*, and the side surface may have an acute angle with respect to the base 200. Also, when the ratio (a:b) of the width a of the top surface to the width b of the bottom surface of the first plated layer 300*a* is below 0:2:1, the second plated layer 300*b* may be rounded from a predetermined area to the top surface. Thus, the ratio of the top surface to the bottom surface of the first plated layer 300*a* may be adjusted so that the top surface has the wide width and the vertical side surface. Also, a ratio of the width b of the bottom surface of the first plated layer 300*a* to the width d of the bottom surface of the second plated layer 300*b* may be 1:1.2 to 1:2, and a distance between the width b of the bottom surface of the first plated layer 300*a* and the adjacent first plated layer 300*a* may have a ratio of 1.5:1 to 3:1. Alternatively, the second plated layers 300*b* may not come into contact with each other. A ratio (c:d) of the widths of the top to bottom surfaces of the coil patterns 300 constituted by the first and second plated layers 300*a* and 300*b* may be 0.5:1 to 0.9:1, preferably, 0.6:1 to 0.8:1. That is, a ratio of widths of the top surface to the bottom surface of an outer appearance of the coil pattern 300, i.e., an outer appearance of the second plated layer 300*b* may be 0.5:1 to 0.9:1. Thus, the coil pattern 300 may have a ratio of 0.5 or less with respect to an ideal rectangular shape in which the rounded area of the edge of the top surface has a right angle. For example, the coil pattern 300 may have a ratio ranging from 0.001 to 0.5 with respect to the ideal rectangular shape in which the rounded area of the edge of the top surface has the right angle. Also, the coil pattern 300 in accordance with an exemplary embodiment may have a relatively low resistance variation when compared to a resistance variation of the ideal rectangular shape. For example, if the coil pattern having the ideal rectangular shape has resistance of 100, resistance the coil pattern 300 may be maintained between values of 101 to 110. That is, the resistance of the coil pattern 300 may be maintained to about 101% to about 110% in accordance with the shape of the first plated layer 300*a* and the shape of the second plated layer 300*b* that varies in accordance with the shape of the first plated layer 300*a* when compared to the resistance of the ideal coil pattern having the rectangular shape. The second plated layer 300*b* may be formed by using the same plating solution as the first plated layer 300*a*. For example, the first and second plated layers 300*a* and 300*b* may be formed by using a plating solution that is based on copper sulfate and sulfuric acid. Here, the plating solution may be improved in plating property of a product by adding chlorine (Cl) having a ppm unit and an organic compound. The organic compound may be improved in uniformity and throwing power of the plated layer and gloss characteristics by using a carrier including polyethylene glycol (PEG) and a polish.

Also, the coil pattern 300 may be formed by laminating at least two plated layers. Here, each of the plated layers may have a vertical side surface and be laminated in the same shape and at the same thickness. That is, the coil pattern 300 may be formed on a seed layer through a plating process. For example, three plated layers may be laminated on the seed layer to form the coil pattern 300. The coil pattern 300 may be formed through an anisotropic plating process and have an aspect ratio of approximately 2 to approximately 10.

Also, the coil pattern 300 may have a shape of which a width gradually increases from the innermost circumferential portion to the outermost circumferential portion thereof. That is, the coil pattern 300 having the spiral shape may include n patterns from the innermost circumference to the outermost circumference. For example, when four patterns are provided, the patterns may have widths that gradually increase in order of a first pattern that is disposed on the innermost circumference, a second pattern, a third pattern, and a fourth pattern that is disposed on the outermost circumference. For example, when the width of the first pattern is 1, the second pattern may have a ratio of 1 to 1.5, the third pattern may have a ratio of 1.2 to 1.7, and the fourth pattern may have a ratio of 1.3 to 2. That is, the first to fourth patterns may have a ratio of 1:1 to 1.5:1.2 to 1.7:1.3 to 2. That is, the second pattern may have a width equal to or greater than that of the first pattern, the third pattern may have a width greater than that of the first pattern and equal to or greater than that of the second pattern, and the fourth pattern may have a width greater than that of each of the first and second patterns and equal to or greater than that of the third pattern. The seed layer may have a width that gradually increases from the innermost circumference to the outermost circumference so that the coil pattern has the width that gradually increases from the innermost circumference to the outermost circumference. Also, widths of at least one region of the coil pattern in a vertical direction may be different from each other. That is, a lower end, an intermediate end, and an upper end of the at least one region may have widths different from each other.

4. External Electrode

The external electrodes 400 (410 and 420) may be disposed on two surfaces facing each other of the body 100. For example, the external electrodes 410 and 420 may be disposed on two side surfaces of the body 100, which face each other in the X direction. The external electrodes 400 may be electrically connected to the coil patterns 310 and 320 of the body 100. Also, the external electrodes 400 may be disposed on the two side surfaces of the body 100 to contact the coil patterns 310 and 320 at central portions of the two side surfaces, respectively. That is, an end of each of the coil patterns 310 and 320 may be exposed to the outer central portion of the body 100, and the external electrode 400 may be disposed on the side surface of the body 100 and then connected to the end of each of the coil patterns 310 and 320. Also, the external electrode 400 may be formed through various methods by using conductive epoxy, conductive paste, deposition, sputtering, and plating. The external electrode 400 may be formed on both side surfaces and only the bottom surface of the body 100. Alternatively, the external electrode 400 may be formed on the top surface or front and rear surfaces of the body 100. For example, when the body 100 is immersed into the conductive paste, the external electrode 400 may be formed on both side surfaces in the X direction, the front and rear surfaces in the Y direction, and the top and bottom surfaces in the Z direction. On the other hand, when the external electrode 400 is formed through the methods such as the printing, the deposition, the sputtering, and the plating, the external electrode 400 may be formed on both side surfaces in the X direction and the bottom surface in the Y direction. That is, the external electrode 400 may be formed on other areas in accordance with the formation method or process conditions as well as both side surfaces in the X direction and the bottom surface on which a printed circuit board is mounted. Also, the external electrode 400 may be formed by mixing, for example, multicomponent glass frit using Bi2O3 or SiO2 of 0.5% to 20% as a main component with metal powder. That is, a portion of the external electrode 400, which comes into contact with the body 100, may be made of a conductive material in which glass is mixed. Here, the mixture of the glass frit and the metal powder may be manufactured in the form of paste and applied to the two surface of the body 100. That is, when a portion of the external electrode 400 is formed by using the conductive paste, the glass frit may be mixed with the conductive paste. As described above, since the glass frit is contained in the external electrode 400, adhesion force between the external electrode 400 and the body 100 may be improved, and a contact reaction between the coil pattern 300 and the external electrode 400 may be improved.

The external electrode 400 may be made of a metal having electrical conductivity, e.g., at least one metal selected from the group consisting of gold, silver, platinum, copper, nickel, palladium, and an alloy thereof. Here, in accordance with an exemplary embodiment, at least a portion of the external electrode 400 connected to the coil pattern 300, i.e., first layers 411 and 421 disposed on the surface of the body 100 and connected to the coil pattern 300 may be formed of the same material as the coil pattern 300. For example, when the coil pattern 300 is formed by using copper, at least a portion of the external electrode 400, i.e., the first layers 411 and 421 may be formed by using copper. Here, as described above, the copper may be deposited or printed through the immersion or printing method using the conductive paste or may be deposited, printed, or plated through the methods such as the deposition, sputtering, and plating. However, a preferred exemplary embodiment, the first layers 411 and 421 of the at least external electrode 400 may be formed through the same method as the coil pattern 300, i.e., the plating. That is, the total thickness of the external electrode 400 may be formed through the copper plating, or a portion of the thickness of the external electrode 400, i.e., the first layers 411 and 421 connected to the coil pattern 300 to come into contact with the surface of the body 100 may be formed through the copper plating. The seed layer is formed on both side surfaces of the body 100 so that the external electrode 400 is formed through the plating process, and then, the plated layer may be formed through the process from the seed layer to form the external electrode 400. Alternatively, the coil pattern 300 exposed to the outside of the body 100 may serve as a seed to form the external electrode 400 through the plating without forming a separate seed layer. An acid treatment process may be performed before the plating process. That is, at least a portion of the surface of the body 100 may be treated with hydrochloric acid and then subjected to the plating process. Although the external electrode 400 is formed through the plating, the external electrode 400 may extend to both side surfaces of the body 100, which face each other, as well as other side surfaces adjacent to both the side surfaces, i.e., the top and bottom surfaces of the body 100. Here, at least a portion of the external electrode 400 connected to the coil pattern 300 may be the entire side surface or a portion of the body 100 on which the external electrode 400 is disposed. The external electrode 400 may further include at least one plated layer. That is, the external electrode 400 may include the first layer 411 and 421 connected to the coil pattern 300 and at least one or more second layers 412 and 422 disposed on a top surface of the first layers. That is, the second layers 412 and 422 may be one layer or two or more layers. For example, the external electrode 400 may further include at least one of a nickel-plated layer (not shown) and a tin-plated layer (not shown) on a copper-plated layer. That is, the external electrode 400 may have a laminated structure of a copper layer, a Ni-plated layer, and an Sn-plated layer or a laminated structure of a copper layer, a Ni-plated layer, and an Sn/Ag-plated layer. Here, the plating may be performed through electrolytic plating or electroless plating. That is, a portion of the thickness of the first layers 411 and 421 may be formed through the electroless plating, and the remaining thickness may be formed through the electrolytic plating, or the total thickness may be formed through the electroless plating or the electrolytic plating. That is, a portion of the thickness of the second layers 412 and 422 may also be formed through the electroless plating, and the remaining thickness may be formed through the electrolytic plating, or the total thickness may be formed through the electroless plating or the electrolytic plating. Alternatively, the first layer 411 and 421 may be formed through the electroless plating or the electrolytic plating, and the second layers 412 and 412 may be formed through the electroless plating or the electrolytic plating like the first layers 411 and 421 or formed through the electrolytic plate or the electroless plating unlike the first layers 411 and 421. Here, the Sn-plated layer of each of the second layers 412 and 422 may have a thickness equal to or greater than that of the Ni-plated layer. For example, the external electrode 400 may have a thickness of 2 μm to 100 μm. Here, each of the first layers 411 and 421 may have a thickness of 1 μm to 50 μm, and each of the second layer 412 and 422 may have a thickness of 1 μm to 50 μm. Here, the external electrode 400 may have the same thickness as each of the first layers 411 and 421 and the second layers 412 and 422 or a thickness different from that of each of the first layers 411 and 421 and the second layers 412 and 422. When the first layer 411 and 421 and the second layers 412 and 422 have thicknesses different from each other, each of the first layers 411 and 421 may have a thickness less or greater than that of each of the second layers 412 and 422. In an exemplary embodiment, each of the first layers 411 and 421 may have a thickness less than that of each of the second layers 412 and 422. The Ni-plated layer of each of the second layers 412 and 422 has a thickness of 1 μm to 10 μm, and an SN- or Sn/Ag-plated layer has a thickness of 2 μm to 10 μm.

As described above, at least a portion of the thickness of the external electrode 400 may be formed by using the same material as the coil pattern 300 and in the same manner as the coil pattern 300 to improve coupling force between the body 100 and the external electrode 400. That is, at least a portion of the external electrode 400 may be formed through the copper plating to improve the coupling force between the coil pattern 300 and the external electrode 400. The power inductor in accordance with an exemplary embodiment may have tensile strength of 2.5 kgf to 4.5 kft. Thus, the tensile strength in accordance with an exemplary embodiment may be improved when compared to that in accordance with the related art. Therefore, the body may not be separated from the electronic device on which the power inductor is mounted.

5. Internal Insulation Layer

The internal insulation layer 500 may be disposed between the coil patterns 310 and 320 and the body 100 to insulate the coil patterns 310 and 320 from the metal powder 110. That is, the internal insulation layer 500 may cover the top and side surfaces of each of the coil patterns 310 and 320. Also, the internal insulation layer 500 may cover the base 200 as well as the top and side surfaces of each of the coil patterns 310 and 320. That is, the internal insulation layer 500 may be formed on an area exposed by the coil patterns 310 and 320 of the base 200 of which a predetermined region is removed, i.e., a surface and side surface of the base 200. The internal insulation layer 500 on the base 200 may have the same thickness as the internal insulation layer 500 on the coil patterns 310 and 320. The internal insulation layer 500 may be formed by applying the parylene on each of the coil patterns 310 and 320. For example, the base 200 on which the coil patterns 310 and 320 are formed may be provided in a deposition chamber, and then, the parylene may be evaporated and supplied into the vacuum chamber to deposit the parylene on the coil patterns 310 and 320. For example, the parylene may be primarily heated and evaporated in a vaporizer to become a dimer state and then be secondarily heated and pyrolyzed into a monomer state. Then, when the parylene is cooled by using a cold trap connected to the deposition chamber and a mechanical vacuum pump, the parylene may be converted from the monomer state to a polymer state and thus be deposited on the coil patterns 310 and 320. Alternatively, the internal insulation layer 500 may be formed of an insulation polymer in addition to the parylene, for example, at least one material selected from epoxy, polyimide, and liquid crystal crystalline polymer. However, the parylene may be applied to form the internal insulation layer 500 having the uniform thickness on the coil patterns 310 and 320. Also, although the internal insulation layer 500 has a thin thickness, the insulation property may be improved when compared to other materials. That is, when the internal insulation layer 500 is coated with the parylene, the internal insulation layer 500 may have a relatively thin thickness and improved insulation property by increasing a breakdown voltage when compared to a case in which the internal insulation layer 500 is made of the polyimide. Also, the parylene may be filled between the coil patterns 310 and 320 at the uniform thickness along a gap between the patterns or formed at the uniform thickness along a stepped portion of the patterns. That is, when a distance between the patterns of the coil patterns 310 and 320 is far, the parylene may be applied at the uniform thickness along the stepped portion of the pattern. On the other hand, the distance between the patterns is near, the gap between the patterns may be filled to form the parylene at a predetermined thickness on the coil patterns 310 and 320. FIG. 8 is a cross-sectional photograph of the power inductor in which the insulation layer is made of polyimide, and FIG. 9 is a cross-sectional photograph of the power inductor in which the insulation layer is made of parylene. As illustrated in FIG. 9, in case of the parylene, although the parylene has a relatively thin thickness along the stepped portion of each of the coil patterns 310 and 320, the polyimide may have a thickness greater than that of the parylene as illustrated in FIG. 8. The internal insulation layer 500 may have a thickness of 3 μm to 100 μm by using the parylene. When the parylene is formed at a thickness of 3 μm or less, the insulation property may be deteriorated. When the parylene is formed at a thickness exceeding 100 μm, the thickness occupied by the internal insulation layer 500 within the same size may increase to reduce a volume of the body 100, and thus, the magnetic permeability may be deteriorated. Alternatively, the internal insulation layer 500 may be manufactured in the form of a sheet having a predetermined thickness and then formed on the coil patterns 310 and 320.

6. Surface Insulation Layer

The surface insulation layer 510 may be formed on the surface of the body 100 on which the external electrode 400 is not formed. That is, the surface insulation layer may be formed on predetermined areas of four surfaces of the body 100 on which the external electrode 400 is not formed. For example, the surface insulation layer 510 may be formed on two surfaces (i.e., front and rear surfaces) facing each other in the Y direction and two surfaces (i.e., top and bottom surfaces) facing each other in the Z direction, on which the external electrode 400 is not formed. Since the external electrode 400 are formed on the two surfaces in the X direction and extends by a predetermined width from edges of the four surfaces in the Y and Z directions, the surface insulation layer 510 may be formed by a predetermined width at central portions of the four surfaces in the Y and Z directions. The surface insulation layer 510 may be formed to form the external electrode 400 at a desired position through the plating process. That is, since the body 100 has substantially the same surface resistance, when the plating process is performed, the plating process may be performed on the entire surface of the body 100. Thus, since the surface insulation layer 510 is formed on the area on which the external electrode 400 is not formed, the external electrode 400 may be formed at the desired position. The surface insulation layer 510 is made of an insulation material. For example, the insulation layer 510 may be made of at least one selected from the group consisting of epoxy, polyimide, and liquid crystalline polymer (LCP). Also, the surface insulation layer 510 may be made of a thermosetting resin. For example, the thermosetting resin may include at least one selected from the group consisting of a novolac epoxy resin, a phenoxy type epoxy resin, a BPA type epoxy resin, a BPF type epoxy resin, a hydrogenated BPA epoxy resin, a dimer acid modified epoxy resin, a urethane modified epoxy resin, a rubber modified epoxy resin, and a DCPD type epoxy resin. That is, the surface insulation layer 510 may be made of a material that is used for the insulation material 120 of the body 100. The surface insulation layer 510 may be formed by applying or printing the polymer and the thermosetting resin to a predetermined area of the body 100. Thus, the surface insulation layer 510 may be formed at the central portions of the four surfaces in the Y and Z directions. The surface insulation layer 510 may be made of parylene. Alternatively, the surface insulation layer 510 may be made of various insulation materials such as $SiO_2$, $Si_3N_4$, and SiON. When the surface insulation layer 510 is made of the above-described materials, the surface insulation layer 510 may be formed through various methods such as CVD and PVD. The surface insulation layer 510 may have the same thickness as the external electrode 400 or a thickness different from that of the external electrode 400, for example, a thickness of 3 μm to 30 μm.

7. Surface Modification Member

A surface modification member (not shown) may be formed on at least one surface of the body 100. The surface modification member may be formed by dispersing oxide onto the surface of the body 100. Here, the oxide may be dispersed and distributed onto the surface of the body 100 in a crystalline state or an amorphous state. Also, at least a portion of the surface modification member distributed on the surface may be melted. The surface modification member may be formed on at least one surface of the body 100 before the external electrode 400 is formed. That is, the surface modification member may be formed before the surface insulation layer 510 is formed or after the surface insulation layer 510 is formed. Since the surface modification member is formed, resistance on the surface of the body 100 may be substantially equally maintained. That is, since at least one surface of the body 100 may have different surface resistance, when the plating process is performed, the plating growth may occur on an area having low resistance, and the plating growth may be reduced or may do not occur on an area having high resistance. For example, there are an area through which the metal powder is exposed and an area through which the metal powder is not exposed on the surface of the body 100 exposed by the surface insulation layer 510. The area through which the metal powder is exposed may have resistance less than that of the area through which the metal powder is not exposed, and thus, the plating layer may be better grown on the area having the relatively low resistance rather than the area having the relatively high resistance. As a result, non-uniform plating layer may be generated. Thus, the surface modification member may be formed on the surface of the body 100 to provide uniform resistance, and thus, the plating layer may be uniformly grown.

At least a portion of the surface modification member may be uniformly distributed on the surface of the body with the same size, and at least a portion may be non-uniformly distributed with sizes different from each other. Also, a recess part may be formed in a surface of at least a portion of the body 100. That is, the surface modification member may be formed to form a convex part. Also, at least a portion of an area on which the surface modification member is not formed may be recessed to form the concave part. Here, at least a portion of the surface modification member may be recessed from the surface of the body 100. That is, a portion of the surface modification member, which has a predetermined thickness, may be inserted into the body 100 by a predetermined depth, and the rest portion of the surface modification member may protrude from the surface of the body 100. Here, the portion of the surface modification member, which is inserted into the body 100 by the predetermined depth, may have a diameter corresponding to 1/20 to 1 of a mean diameter of oxide particles. That is, all the oxide particles may be impregnated into the body 100, or at least a portion of the oxide particles may be impregnated. Alternatively, the oxide particles may be formed on only the surface of the body 100. Thus, each of the oxide particles may be formed in a hemispherical shape on the surface of the body 100 and in a globular shape. Also, as described above, the surface modification member may be partially distributed on the surface of the body or distributed in a film shape on at least one area of the body 100. That is, the oxide particles may be distributed in the form of an island on the surface of the body 100 to form the surface modification member. That is, the oxide particles having the crystalline state or the amorphous state may be spaced apart from each other on the surface of the body 100 and distributed in the form of the island. Thus, at least a portion of the surface of the body 100 may be exposed. Also, at least two oxide particles may be connected to each other to form the film on at least one area of the surface of the body 100 and the island shape on at least a portion of the surface of the body 100. That is, at least two oxide particles may be aggregated, or the oxide particles adjacent to each other may be connected to each other to form the film. However, although the oxide exists in the particle state, or at least two particles are aggregated with or connected to each other, at least a portion of the surface of the body 100 may be exposed to the outside by the surface modification member.

Here, the total area of the surface modification member may correspond to 5% to 90% of the entire area of the surface of the body 100. Although a plating blurring phenomenon on the surface of the body 100 is controlled in accordance with the surface area of the surface modification member, if the surface modification member is widely formed, the contact between the conductive pattern and the external electrode 400 may be difficult. That is, when the surface modification member is formed on an area of 5% or less of the surface area of the body 100, it may be difficult to control the plating blurring phenomenon. When the surface modification member is formed on an area exceeding 90%, the conductive pattern may not contact the external electrode 400. Thus, it is preferable that a sufficient area on which the plating blurring phenomenon of the surface modification member is controlled, and the conductive pattern contacts the external electrode 400 is formed. For this, the surface modification member may be formed with a surface area of 10% to 90%, preferably, 30% to 70%, more preferably, 40% to 50%. Here, the surface area of the body 100 may be a surface area of one surface thereof or a surface area of six surfaces of the body 100, which define a hexahedral shape. The surface modification member may have a thickness of 10% or less of the thickness of the body 100. That is, the surface modification member may have a thickness of 0.01% to 10% of the thickness of the body 100. For example, the surface modification member may have a size of 0.1 μm to 50 μm. Thus, the surface modification member may have a thickness of 0.1 μm to 50 μm from the surface of the body 100. That is, the surface modification member may have a thickness of 0.1% to 50% of the thickness of the body 100 except for the portion inserted from the surface of the body 100. Thus, the surface modification member may have a thickness greater than that of 0.1 μm to 50 μm when the thickness of the portion inserted into the body 100 is added. That is, when the surface modification member has a thickness of 0.01% or less of the thickness of the body 100, it may be difficult to control the plating blurring phenomenon. When the surface modification member has a thickness exceeding 10%, the conductive pattern within the body 100 may not contact the external electrode 400. That is, the surface modification member may have various thicknesses in accordance with material properties (conductivity, semiconductor properties, insulation, magnetic materials, and the like) of the body 100. Also, the surface modification member may have various thicknesses in accordance with sizes, distributed amount, whether the aggregation occurs, and the like) of the oxide powder.

Since the surface modification member is formed on the surface of the body 100, two areas, which are mode of components different from each other, of the surface of the body 100 may be provided. That is, components different from each other may be detected from the area on which the surface modification member is formed and the area on which the surface modification member is not formed. For example, a component due to the surface modification member, i.e., oxide may exist on the area on which the surface modification member is formed, and a component due to the body 100, i.e., a component of the sheet may exist on the area on which the surface modification member is not formed. Since the surface modification member is distributed on the surface of the body before the plating process, roughness may be given to the surface of the body 100 to modify the surface of the body 100. Thus, the plating process may be uniformly performed, and thus, the shape of the external electrode 400 may be controlled. That is, resistance on at least an area of the surface of the body 100 may be different from that on the other area of the surface of the body 100. When the plating process is performed in a state in which the resistance is non-uniform, ununiformity in growth of the plating layer may occur. To solve this limitation, the oxide that is in a particle state or melted state may be dispersed on the surface of the body 100 to form the surface modification member, thereby modifying the surface of the body 100 and controlling the growth of the plated layer.

Here, at least one oxide may be used as the oxide, which is in the particle or melted state, for realizing the uniform surface resistance of the body 100. For example, at least one of $Bi_2O_3$, $BO_2$, $B_2O_3$, ZnO, $Co_3O_4$, $SiO_2$, $Al_2O_3$, MnO, $H_2BO_3$, $Ca(CO_3)_2$, $Ca(NO_3)_2$, and $CaCO_3$ may be used as the oxide. The surface modification member may be formed on at least one sheet within the body 100. That is, the conductive pattern having various shapes on the sheet may be formed through the plating process. Here, the surface modification member may be formed to control the shape of the conductive pattern.

8. Capping Insulation Layer

As illustrated in FIG. 1, a capping insulation layer 550 may be disposed on the top surface of the body 100 on which the external electrode 400 is disposed. That is, the capping insulation layer 550 may be disposed on the bottom surface of the body 100 and the top surface facing the bottom surface of the body 100 mounted on a printed circuit board (PCB), e.g., the top surface of the body 100 in the Z direction. The capping insulation layer 550 may be provided to prevent the external electrode 400 disposed on the top surface of the body 100 to extend from being short-circuited with a shield can or circuit component and the power inductor disposed above the external electrode 400. That is, in the power inductor, the external electrode 400 disposed on the bottom surface of the body 100 may be adjacent to a power management IC (PMIC) and mounted on the printed circuit board. The PMIC may have a thickness of approximately 1 mm, and the power inductor may also have the same thickness as the PMIC. The PMIC may generate high frequency noises to affect surrounding circuits or devices. Thus, the PMIC and the power inductor may be covered by the shield can that is made of a metal material, e.g., a stainless steel material. However, the power inductor may be short-circuited with the shield can because the external electrode is also disposed thereabove. Thus, the capping insulation layer 550 may be disposed on the top surface of the body 100 to prevent the power inductor from being short-circuited with an external conductor. The capping insulation layer 550 is made of an insulation material. For example, the capping insulation layer 550 may be made of at least one selected from the group consisting of epoxy, polyimide, and liquid crystalline polymer (LCP). Also, the capping insulation layer 550 may be made of a thermosetting resin. For example, the thermosetting resin may include at least one selected from the group consisting of a novolac epoxy resin, a phenoxy type epoxy resin, a BPA type epoxy resin, a BPF type epoxy resin, a hydrogenated BPA epoxy resin, a dimer acid modified epoxy resin, a urethane modified epoxy resin, a rubber modified epoxy resin, and a DCPD type epoxy resin. That is, the capping insulation layer 550 may be made of a material that is used for the insulation material 120 or the surface insulation layer 510 of the body 100. The capping insulation layer 550 may be formed by immersing the top surface of the body 100 into the polymer or the thermosetting resin. Thus, as illustrated in FIGS. 1 and 10, the capping insulation layer 550 may be disposed on a portion of each of both side surfaces in the X direction of the body 100 and a portion of each of the front and rear surfaces in the Y direction as well as the top surface of the body 100. The capping insulation layer 550 may be made of parylene. Alternatively, the capping insulation layer 550 may be made of various insulation materials such as $SiO_2$, $Si_3N_4$, and SiON. When the capping insulation layer 550 is made of the above-described materials, the capping insulation layer 550 may be formed through various methods such as CVD and PVD. When the capping insulation layer 550 is formed through the CVD or PVD, the capping insulation layer 550 may be formed on only the top surface of the body 100. The capping insulation layer 550 may have a thickness that is enough to prevent the external electrode 400 of the power inductor 100 from being short-circuited with the shield can, e.g., a thickness of 10 μm to 100 μm. The capping insulation layer 550 may have a thickness equal to or different from that of the external electrode 400 and have a thickness equal to or different from that of the surface insulation layer 510. For example, the capping insulation layer 550 may have a thickness greater than that of each of the external electrode 400 and the surface insulation layer 510. Alternatively, the capping insulation layer 550 may have a thickness less than that of the external electrode 400 and equal to that of the surface insulation layer 510. Also, the capping insulation layer 550 may be formed at the uniform thickness on the top surface of the body 100 so that a stepped portion is maintained between the external electrode 400 and the body 100. Alternatively, the capping insulation layer 550 may have a thickness on the top surface of the body, which is thicker than that of the top surface of the external electrode 400, and thus be planarized to remove the stepped portion between the external electrode 400 and the body 100. Alternatively, the capping insulation layer 550 may be manufactured with a predetermined thickness and then be adhered to the body 100 by using an adhesive.

As described above, in the power inductor in accordance with an exemplary embodiment, the capping insulation layer 550 may be formed on the top surface of the body 100 to prevent the external electrode 400 from being exposed. Thus, the contact of the external electrode 400 with the shield can may be prevented to prevent the short circuit from occurring. Also, a thickness of at least a portion of the external electrode 400 may be formed by using the same material as the coil pattern 300 in the same manner as the coil pattern 300 to improve the coupling force between the body 100 and the external electrode 400. That is, the external electrode 400 may be formed through the copper plating to improve the coupling force between the coil pattern 300 and the external electrode 400. Thus, the tensile strength may be improved, and also, the body may not be separated from the electronic device on which the power inductor in accordance with an exemplary embodiment is mounted. Also, since the body 100 including the thermal conductive filler 130 in addition to the metal powder 110 and the insulation material 120 is manufactured, the heat of the body 100 due to the heating of the metal powder 110 may be released to the outside to prevent the body from increasing in temperature and also from the inductance from being reduced. Also, since the internal insulation layer 500 is formed between the coil patterns 310 and 320 and the body 100 by using the parylene, the internal insulation layer 500 may be formed with a thin thickness on the side surface and the top surface of each of the coil patterns 310 and 320 to improve the insulation property.

Experimental Example

In an exemplary embodiment, at least a portion of the external electrode 400 may be formed through copper plating, like the coil pattern 300 to improve the coupling force between the external electrode 400 and the coil pattern 300. As described above, tensile strength in accordance with an embodiment in which the external electrode is formed through the copper plating and the related art in which the external electrode is formed by applying epoxy was compared to each other through a test.

First, to measure the tensile strength, a wire was soldered on the external electrode after the external electrode is formed, and then, the soldered wire was pulled to measure the tensile strength. That is, the tensile strength was measured when the body 100 is torn or separated from the external electrode 400 by pulling the wire. Here, in the related art, the external electrode was formed by applying the epoxy. In Embodiment 1, the external electrode was formed through the electrolytic plating, and in Embodiment 2, the external electrode was formed through the electrolytic plating and the electroless plating. The body, the base, and the coil pattern except for the external electrode had the same shape as the related art. A plurality of power inductors in accordance with the related art and Embodiments 1 and 2 were manufactured to measure tensile strength and calculate a mean value of the tensile strength.

Figure 11:
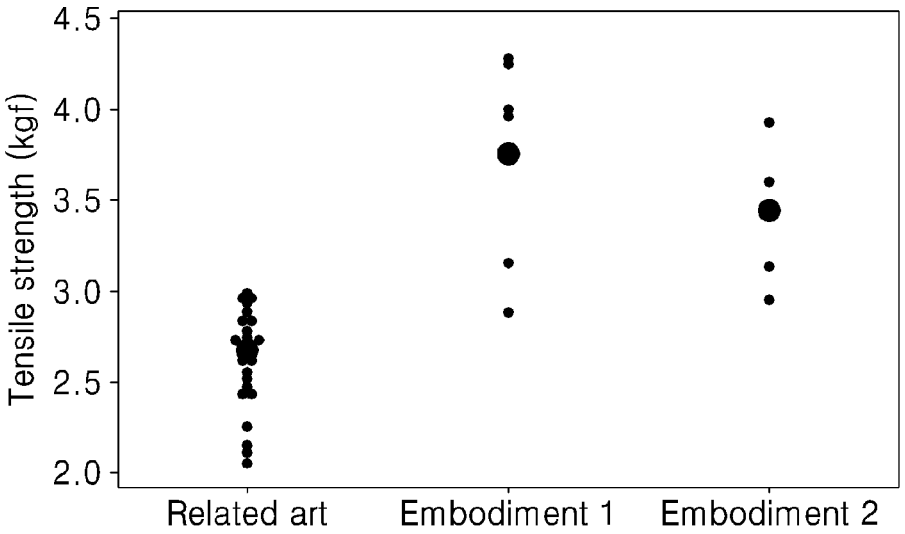
FIG. 11 is a graph illustrating tensile strength of the power inductors in accordance with a related art and an exemplary embodiment.

FIG. 11 is a graph illustrating tensile strength in accordance with the related art and Embodiments. Here, the tensile strength refers to force when the external electrode is separated from the body by increasing pulling force of the wire. As illustrated in FIG. 11, in the related art, the tensile strength was measured in a range of 2.057 kgf to 2.9910 kgf and had a mean value of 2.679 kgf. However, Embodiment 1, the tensile strength was measured in a range of 2.884 kgf to 4.285 kgf and had a mean value of 3.603 kgf Also, in Embodiment 2, the tensile strength was measured in a range of 2.959 kgf to 3.940 kgf and had a mean value of 3.453 kgf For reference, in the drawings, the dark and large area is a mean value, and an area displayed with a light color is distribution of measured values. Thus, it is seen that the tensile strength in accordance with Embodiments is higher than that in accordance with a comparison example. Also, in Embodiments, it is seen that the tensile strength in accordance with Embodiment 1 in which the external electrode is formed through the electrolytic plating is higher than that in accordance with Embodiment 2 in which the external electrode is formed through the electroless plating and the electrolytic plating. Thus, in Embodiments, the coupling force between the external electrode and the body or the coil pattern may be improved, and thus, when mounted on the electronic device, the separation of the body may be prevented.

Figure 12:
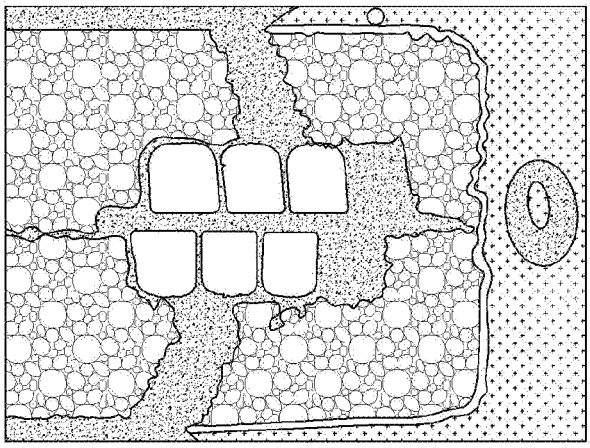
FIG. 12 is a cross-sectional photograph after a tensile strength test of the power inductor in accordance with an exemplary embodiment.

In an exemplary embodiment, when the tensile force is continuously applied, the body may be broken. That is, as illustrated in FIG. 12, when the tensile force is continuously applied, a phenomenon in which the body is broken may occur. That is, although the external electrode is separated from the body by the tensile force in the related art, the body may be broken by the continuous applying of the tensile force because the coupling force between the body and the external electrode is greater than that between the coil pattern and the external electrode in an exemplary embodiment. That is, in an exemplary embodiment, the strong coupling force that is sufficient for preventing the body and the external electrode from being separated from each other may be provided even if the body is broken.

In an exemplary embodiment, a pretreatment process may be performed by using, for example, hydrochloric acid before the external electrode is formed through the plating. [Table 1] shows the tensile strength measurement results of Embodiments 1 and 2 depending on a pretreatment time using the hydrochloric acid.

TABLE 1

| | Pretreatment Time | Electroless Plating | Electrolytic Plating | Tensile Strength (kgf) | Destruction Mode |
|---|---|---|---|---|---|
| Embodiment 1 | 30 Seconds | ○ | ○ | 2.959~3.144 | Body Break |
| | 90 Seconds | ○ | ○ | 3.137~3.940 | Body Break |
| | 180 Seconds | ○ | ○ | 3.603~3.933 | Body Break |
| Embodiment 2 | 30 Seconds | X | ○ | 4.002~4.257 | Body Break |
| | 90 Seconds | X | ○ | 3.962~4.285 | Body Break |
| | 180 Seconds | X | ○ | 2.884~3.163 | Body Break |

As shown in [Table 1], in case of Embodiment 1, it is seen that the tensile strength increases as the pretreatment time increases. In case of Embodiment 2, it is seen that the tensile strength decreases as the pretreatment time increases. However, it is seen that the tensile strength in Embodiment 1 is greater than that in Embodiment 2 even when the pretreatment process is performed. Thus, the tensile strength may be adjusted in accordance with the plating types, the pretreatment times, and the like.

Another Embodiment

Hereinafter, other embodiments will be described. Here, the detailed description of the contents overlapping with the foregoing embodiment will be omitted, and unless otherwise stated, the detailed configuration of other embodiments is the same as that of the foregoing embodiment. For example, although the first layer and the second layer are not separately shown, the external electrode 400 may include a first layer formed through copper plating and a second layer formed through nickel or tin plating in following exemplary embodiments. Also, a surface insulation layer 510 may be formed on an area, on which an electrode including an external electrode 400 is not formed, on a surface of the body 100.

Figure 13:
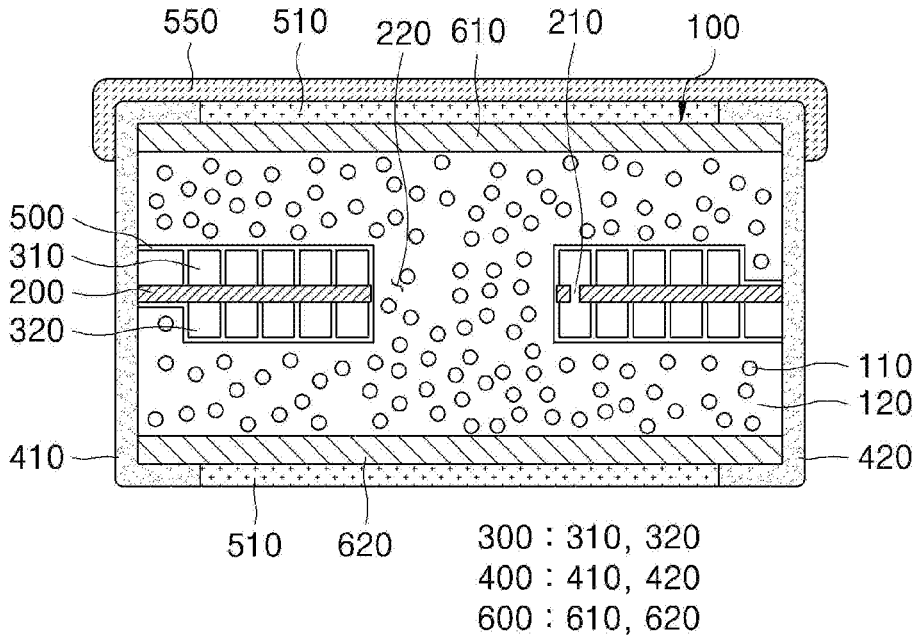
FIGS. 13 and 14 are cross-sectional views of a power inductor according to another exemplary embodiment of the present invention.

FIG. 13 is a perspective view of a power inductor in accordance with another exemplary embodiment.

Referring to FIG. 13, a power inductor in accordance with another exemplary embodiment may include a body 100, a base 200 provided in the body 100, coil patterns 310 and 320 disposed on at least one surface of the base 200, external electrodes 410 and 420 provided outside the body 100, an internal insulation layer 500 provided on each of the coil patterns 310 and 320, and at least one magnetic layer 600 (610 and 620) provided on each of top and bottom surfaces of the body 100. That is, another exemplary embodiment may be realized by further providing the magnetic layer 600 in accordance with the foregoing embodiment. Hereinafter, constitutions different from those in accordance with the foregoing embodiment will be mainly described in accordance with another exemplary embodiment.

The magnetic layer 600 (610 and 620) may be disposed on at least one area of the body 100. That is, a first magnetic layer 610 may be disposed on the top surface of the body 100, and the second magnetic layer 620 may be disposed on the bottom surface of the body 100. Here, the first and second magnetic layers 610 and 620 may be provided to improve magnetic permeability of the body 100 and also may be made of a material having magnetic permeability greater than that of the body 100. For example, the body 100 may have magnetic permeability of 20, and each of the first and second magnetic layers 610 and 620 may have magnetic permeability of 40 to 1000. Each of the first and second magnetic layers 610 and 620 may be manufactured by using, for example, magnetic powder and an insulation material. That is, each of the first and second magnetic layers 610 and 620 may be made of a material having magnetism greater than that of the magnetic material of the body 100 or having a content of the magnetic material greater than that of the magnetic material of the body so as to have magnetic permeability greater than that of the body 100. For example, 1 wt % to 2 wt % of the insulation material with respect to 100 wt % of metal powder may be added to the first and second magnetic layers 610 and 620. That is, the magnetic layers 610 and 620 may contain more metal powder than that of the body 100. Also, the metal powder may use one selected from the group consisting of Ni ferrite, Zn ferrite, Cu ferrite, Mn ferrite, Co ferrite, Ba ferrite and Ni—Zn—Cu ferrite or at least one oxide magnetic material thereof. That is, the magnetic layer 600 may be formed by using metal alloy powder including iron or metal alloy oxide containing iron. Also, a magnetic material may be applied to the metal alloy powder to form magnetic powder. For example, at least one oxide magnetic material selected from the group consisting of a Ni oxide magnetic material, a Zn oxide magnetic material, a Cu oxide magnetic material, a Mn oxide magnetic material, a Co oxide magnetic material, a Ba oxide magnetic material, and a Ni—Zn—Cu oxide magnetic material may be applied to the metal alloy powder including iron to form the magnetic powder. That is, the metal oxide including iron may be applied to the metal alloy powder to form the magnetic powder. Alternatively, at least one oxide magnetic material selected from the group consisting of a Ni oxide magnetic material, a Zn oxide magnetic material, a Cu oxide magnetic material, a Mn oxide magnetic material, a Co oxide magnetic material, a Ba oxide magnetic material, and a Ni—Zn—Cu oxide magnetic material may be mixed with the metal alloy powder including iron to form the magnetic powder. That is, the metal oxide including iron may be mixed with the metal alloy powder to form the magnetic powder. Each of the first and second magnetic layers 610 and 620 may further include a thermal conductive filler (not shown) in addition to the metal powder and the insulation material. The thermal conductive filler may be contained to a content of 0.5 wt % to 3 wt % with respect to 100 wt % of the metal powder. Each of the first and second magnetic layers 610 and 620 may be manufactured in the form of a sheet and disposed on each of the top and bottom surfaces of the body 100 on which the plurality of sheets are laminated. Also, paste made of a material including the metal powder 110 and the insulation material 120 or further including the thermal conductive filler may be printed to a predetermined thickness or may be put into a frame and then compressed to form the body 100, thereby forming the first and second magnetic layers 610 and 620 on the top and bottom surfaces of the body 100. Also, each of the first and second magnetic layers 610 and 620 may be formed by using paste. That is, a magnetic material may be applied to the top and bottom surfaces of the body 100 to form the first and second magnetic layer 610 and 620.

Figure 14:
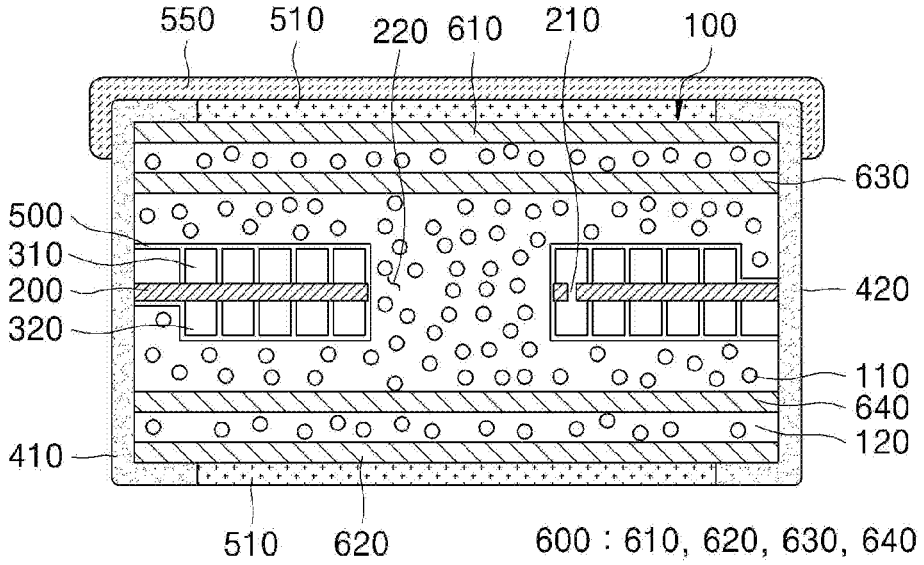

In the power inductor in accordance with another exemplary embodiment, third and fourth magnetic layers 630 and 640 may be further provided between the first and second magnetic layers 610 and 620 and the base 200 as illustrated in FIG. 14. That is, at least one magnetic layer 600 may be provided in the body 100. The magnetic layer 600 may be manufactured in the form of the sheet and disposed in the body 100 on which the plurality of sheets are laminated. That is, at least one magnetic layer 600 may be provided between the plurality of sheets for manufacturing the body 100. Also, when the paste made of the material including the metal powder 110, the insulation material 120, and the thermal conductive filler 130 are printed at a predetermined thickness to form the body 100, the magnetic layer may be formed during the printing. When the paste is put into a frame and then pressed, the magnetic layer may be disposed between the paste and the frame, and then, the pressing may be performed. Of course, the magnetic layer 600 may be formed by using the paste. Here, when the body 100 is formed, a soft magnetic material may be applied to form the magnetic layer 600 within the body 100.

As described above, in the power inductor according to another embodiment of the present invention, the at least one magnetic layer 600 may be provided in the body 100 to improve the magnetic permeability of the power inductor.

Figure 15:
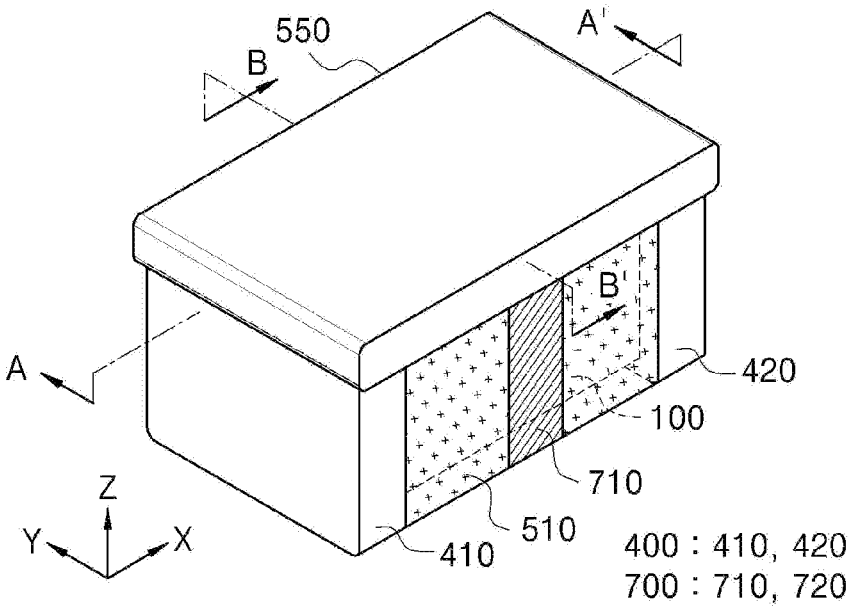
FIG. 15 is a perspective view of a power inductor in accordance with further another exemplary embodiment.
Figure 16:
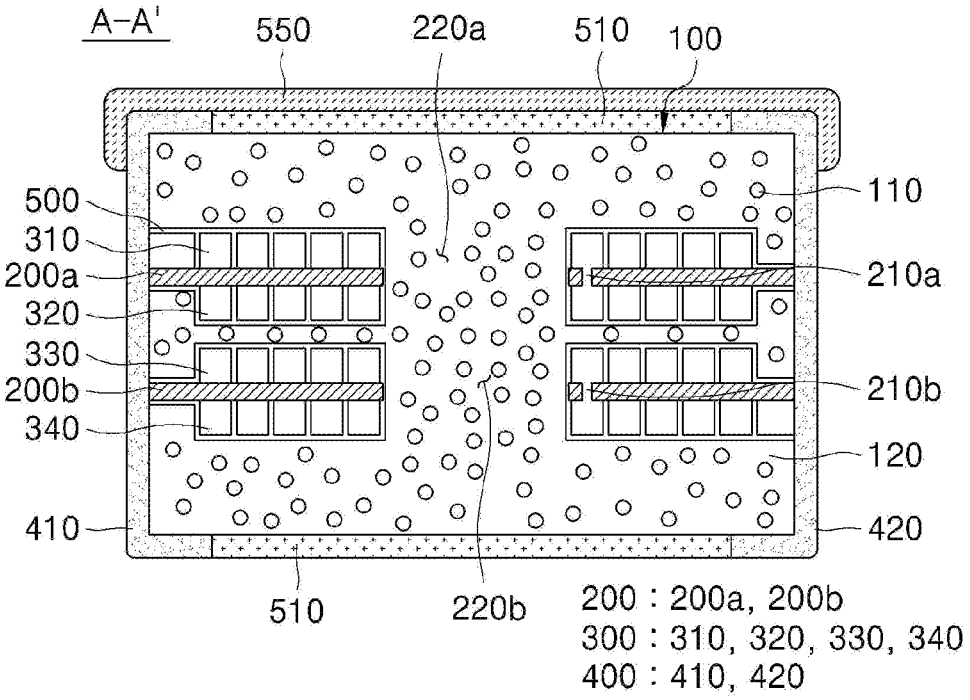
FIGS. 16 and 17 are cross-sectional views taken along lines A-A' and B-B' of FIG. 15, respectively.
Figure 17:
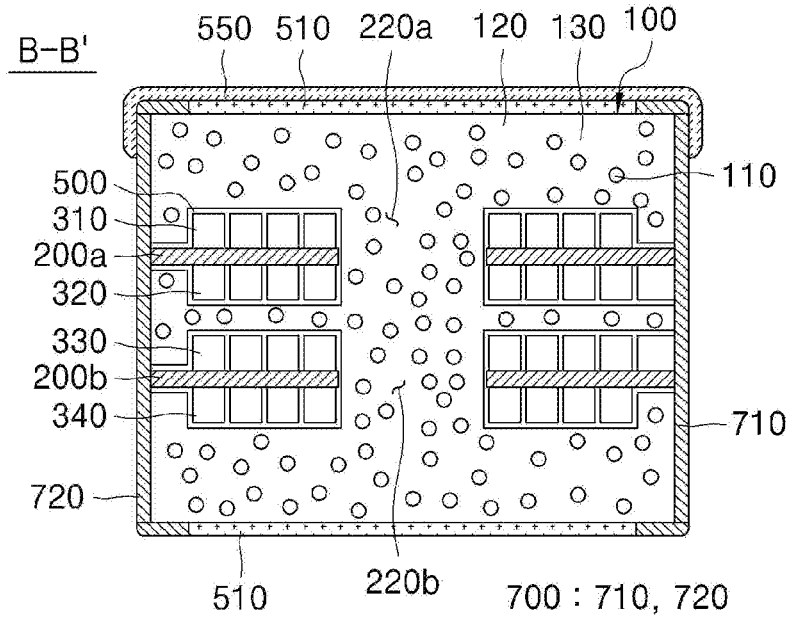

FIG. 15 is a perspective view of a power inductor in accordance with further another exemplary embodiment, FIG. 16 is a cross-sectional view taken along line A-A' of FIG. 15, and FIG. 17 is a cross-sectional view taken along line B-B' of FIG. 15.

Referring to FIGS. 15 to 17, a power inductor in accordance with further another exemplary embodiment may include a body 100, at least two bases 200 (200*a* and 200*b*) provided in the body 100, coil patterns 300 (310, 320, 330, and 340) disposed on at least one surface of each of the at least two bases 200, external electrodes 410 and 420 disposed outside the body 100, an internal insulation layer 500 disposed on the coil patterns 300, and connection electrodes 700 (710 and 720) spaced apart from the external electrodes 410 and 420 outside the body 100 and connected to at least one coil pattern 300 disposed on each of at least two boards 200 within the body 100. Hereinafter, descriptions duplicated with those in accordance with the foregoing embodiments will be omitted.

The at least two bases 200 (200*a* and 200*b*) may be provided in the body 100 and spaced a predetermined distance from each other a short axial direction of the body 100. That is, the at least two bases 200 may be spaced a predetermined distance from each other in a direction perpendicular to the external electrode 400, i.e., in a thickness direction of the body 100. Also, conductive vias 210 (210*a* and 210*b*) may be formed in the at least two bases 200, respectively. Here, at least a portion of each of the at least two bases 200 may be removed to form each of through holes 220 (220*a* and 220*b*). Here, the through holes 220*a* and 220*b* may be formed in the same position, and the conductive vias 210*a* and 210*b* may be formed in the same position or positions different from each other. Of course, an area of the at least two bases 200, in which the through-hole 220 and the coil pattern 300 are not provided, may be removed, and then, the body 100 may be filled. The body 100 may be disposed between the at least two bases 200. The body 100 may be disposed between the at least two bases 200 to improve magnetic permeability of the power inductor. Of course, since the internal insulation layer 500 is disposed on the coil pattern 300 disposed on the at least two bases 200, the body 100 may not be provided between the bases 200. In this case, the power inductor may be reduced in thickness.

The coil patterns 300 (310, 320, 330, and 340) may be disposed on at least one surface of each of the at least two bases 200, preferably, both surfaces of each of the at least two bases 200. Here, the coil patterns 310 and 320 may be disposed on lower and upper portions of a first substrate 200*a* and electrically connected to each other by the conductive via 210*a* provided in the first base 200*a*. Similarly, the coil patterns 330 and 340 may be disposed on lower and upper portions of a second substrate 200*b* and electrically connected to each other by the conductive via 210*b* provided in the second base 200*b*. Each of the plurality of coil patterns 300 may be formed in a spiral shape on a predetermined area of the base 200, e.g., outward from the through-holes 220*a* and 220*b* in a central portion of the base 200. The two coil patterns 310 and 320 disposed on the base 200 may be connected to each other to form one coil. That is, at least two coils may be provided in one body 100. Here, the upper coil patterns 310 and 330 and the lower coil patterns 320 and 340 of the base 200 may have the same shape. Also, the plurality of coil patterns 300 may overlap each other. Alternatively, the lower coil patterns 320 and 340 may be disposed to overlap an area on which the upper coil patterns 310 and 330 are not disposed.

The external electrodes 400 (410 and 420) may be disposed on both ends of the body 100. For example, the external electrodes 400 may be disposed on two side surfaces of the body 100, which face each other in a longitudinal direction. The external electrode 400 may be electrically connected to the coil patterns 300 of the body 100. That is, at least one end of each of the plurality of coil patterns 300 may be exposed to the outside of the body 100, and the external electrode 400 may be connected to the end of each of the plurality of coil patterns 300. For example, the external electrode 410 may be connected to the coil pattern 310, and the external pattern 420 may be connected to the coil pattern 340. That is, the external electrode 400 may be connected to each of the coil patterns 310 and 340 disposed on the bases 200*a* and 200*b*.

The connection electrode 700 may be disposed on at least one side surface of the body 100, on which the external electrode 400 is not provided. For example, the external electrode 400 may be disposed on each of first and second side surfaces facing each other, and the connection electrode 700 may be disposed on each of third and fourth side surfaces on which the external electrode 400 is not provided. The connection electrode 700 may be provided to connect at least one of the coil patterns 310 and 320 disposed on the first base 200*a* to at least one of the coil patterns 330 and 340 disposed on the second base 200*b*. That is, the connection electrode 710 may connect the coil pattern 320 disposed below the first base 200*a* to the coil pattern 330 disposed above the second base 200*b* at the outside of the body 100. That is, the external electrode 410 may be connected to the coil pattern 310, the connection electrode 710 may connect the coil patterns 320 and 330 to each other, and the external electrode 420 may be connected to the coil pattern 340. Thus, the coil patterns 310, 320, 330, and 340 disposed on the first and second bases 200*a* and 200*b* may be connected to each other in series. Although the connection electrode 710 connects the coil patterns 320 and 330 to each other, the connection electrode 720 may not be connected to the coil patterns 300. This is done because, for convenience of processes, two connection electrodes 710 and 720 are provided, and only one connection electrode 710 is connected to the coil patterns 320 and 330. The connection electrode 700 may be formed by immersing the body 100 into conductive paste or formed on one side surface of the body 100 through various methods such as plating, printing, deposition, and sputtering. Preferably, the connection electrode 700 may be formed in the same manner as the external electrode 400, i.e., the plating. The connection electrode 700 may include a metal have electrical conductivity, e.g., at least one metal selected from the group consisting of gold, silver, platinum, copper, nickel, palladium, and an alloy thereof. Here, a nickel-plated layer (not show) and a tin-plated layer (not shown) may be further disposed on a surface of the connection electrode 700.

Figure 18:
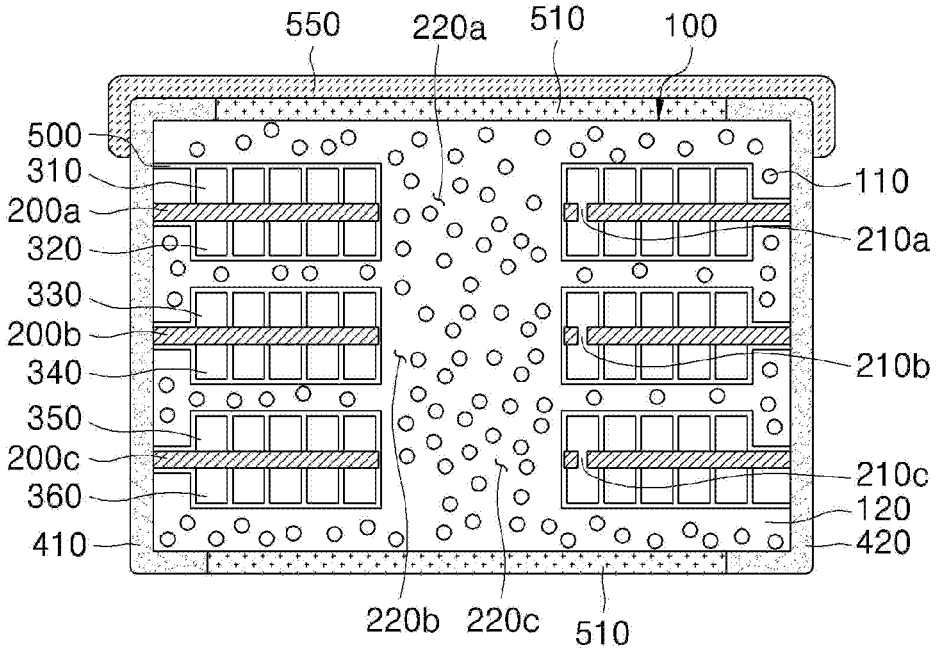
FIGS. 18 and 19 are cross-sectional views taken along lines A-A' and B-B' of FIG. 13 in accordance with further another exemplary embodiment.
Figure 19:
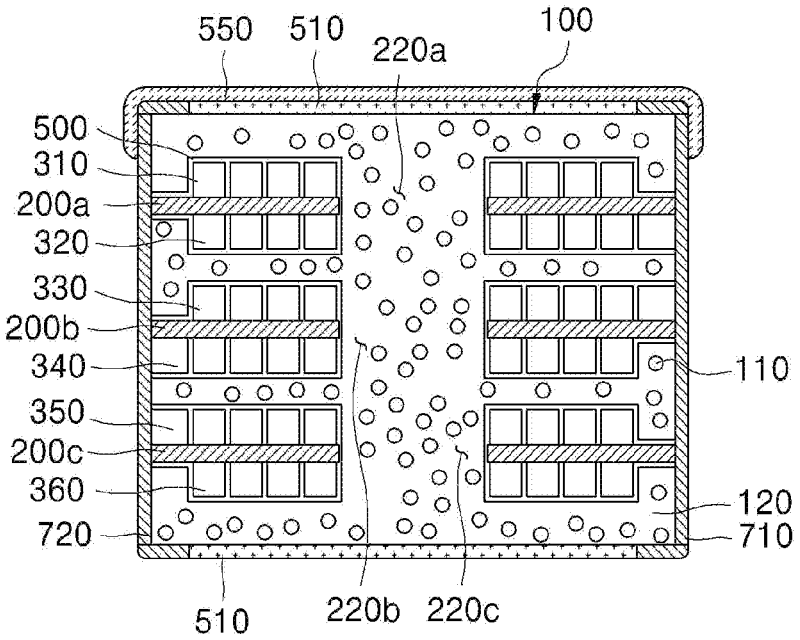

FIGS. 18 and 19 are cross-sectional views illustrating a modified example of the power inductor in accordance with further another exemplary embodiment. That is, three bases 200 (200*a*, 200*b*, and 200*c*) may be provided in the body 100, coil patterns 300 (310, 320, 330, 340, 350, and 360) may be disposed on one surface and the other surface of each of the bases 200, the coil patterns 310 and 360 may be connected to external electrodes 410 and 420, and coil patterns 320 and 330 may be connected to a connection electrode 710, and the coil patterns 340 and 350 may be connected to a connection electrode 720. Thus, the coil patterns 300 respectively disposed on the three bases 200*a*, 200*b*, and 200*c* may be connected to each other in series by the connection electrodes 710 and 720.

As described above, in the power inductors in accordance with further another exemplary embodiment and modified examples, the at least two bases 200 on which each of the coil patterns 300 is disposed on at least one surface may be spaced apart from each other within the body 100, and the coil pattern 300 disposed on the other base 200 may be connected by the connection electrode 700 outside the body 100. As a result, the plurality of coil patterns may be provided within one body 100, and thus, the power inductor may increase in capacity. That is, the coil patterns 300 respectively disposed on the bases 200 different from each other may be connected to each other in series by using the connection electrode 700 outside the body 100, and thus, the power inductor may increase in capacity on the same area.

Figure 20:
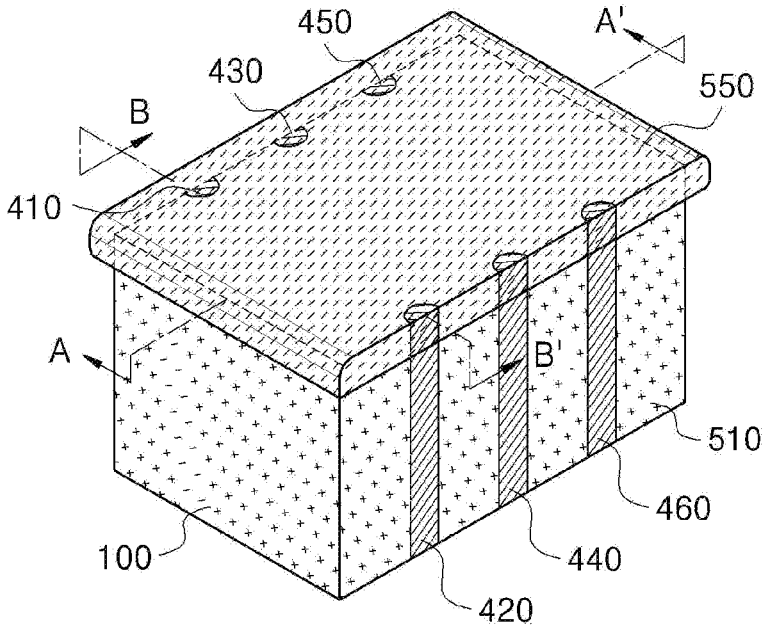
FIG. 20 is a perspective view of a power inductor in accordance with still another exemplary embodiment.
Figure 21:
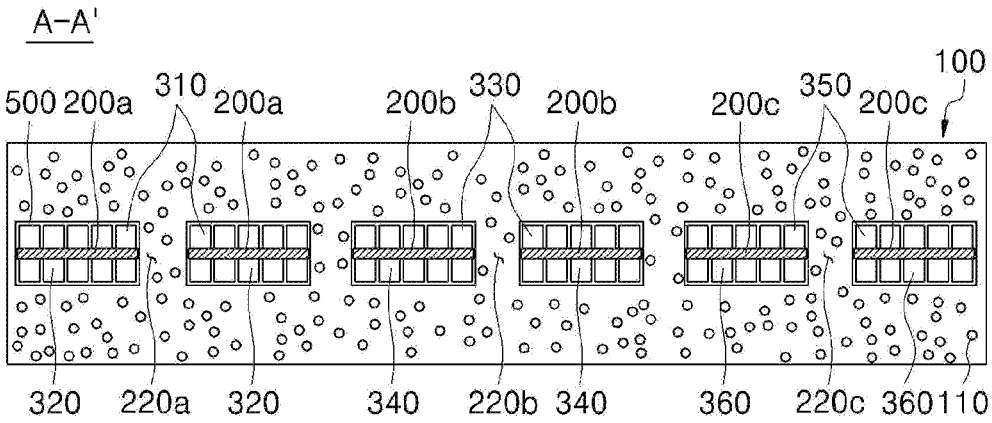
FIGS. 21 and 22 are cross-sectional views taken along lines A-A' and B-B' of FIG. 20, respectively.
Figure 22:
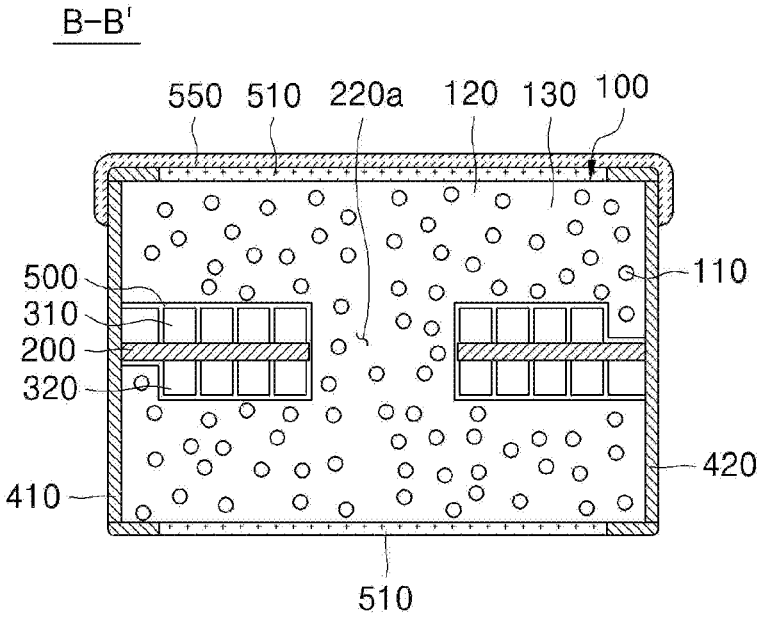
Figure 23:
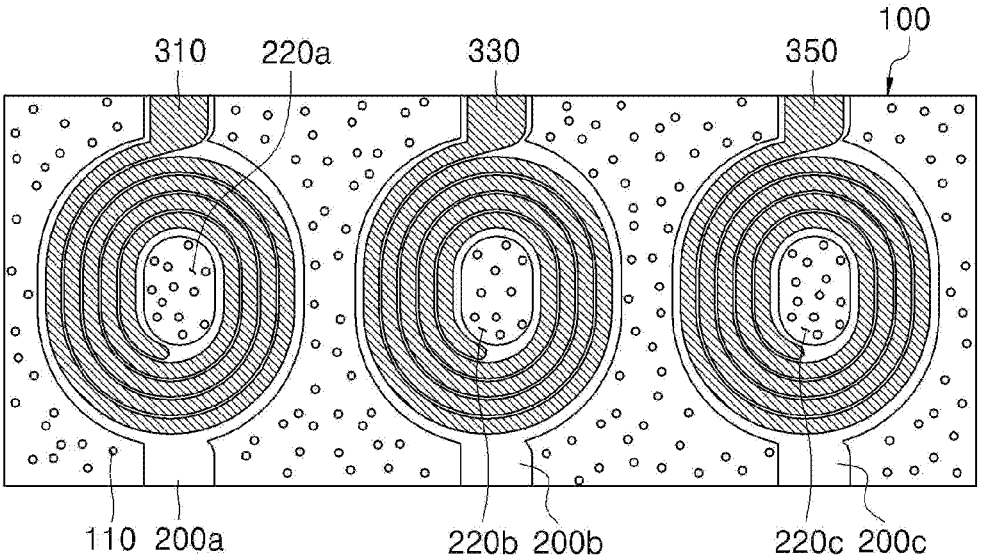
FIG. 23 is an internal plan view of FIG. 20.

FIG. 20 is a perspective view of a power inductor in accordance with still another exemplary embodiment, and FIGS. 21 and 22 are cross-sectional views taken along lines A-A' and B-B' of FIG. 20. Also, FIG. 23 is an internal plan view.

Referring to FIGS. 20 to 23, a power inductor in accordance with further another exemplary embodiment may include a body 100, at least two bases 200 (200*a*, 200*b*, and 200*c*) provided in the body 100 in a horizontal direction, coil patterns 300 (310, 320, 330, 340, 350, and 360) disposed on at least one surface of each of the at least two bases 200, external electrodes 400 (410, 420, 430, 440, 450, and 460) disposed outside the body 100 and disposed on the at least two bases 200*a*, 200*b*, and 200*c*, and an internal insulation layer 500 disposed on the coil patterns 300. Hereinafter, descriptions duplicated with the foregoing embodiments will be omitted.

At least two, e.g., three bases 200 (200*a*, 200*b*, and 200*c*) may be provided in the body 100. Here, the at least two bases 200 may be spaced a predetermined distance from each other in a long axis direction that is perpendicular to a thickness direction of the body 100. That is, in further another exemplary embodiment and the modified example, the plurality of bases 200 are arranged in the thickness direction of the body 100, e.g., in a vertical direction. However, in still another exemplary embodiment, the plurality of bases 200 may be arranged in a direction perpendicular to the thickness direction of the body 100, e.g., a horizontal direction. Also, conductive vias 210 (210*a*, 210*b*, and 210*c*) may be formed in the plurality of bases 200, respectively. Here, at least a portion of each of the plurality of bases 200 may be removed to form each of through holes 220 (220*a*, 220*b*, and 220*c*). Of course, an area of the plurality of bases 200, in which the through-holes 220 and the coil patterns 300 are not provided, may be removed as illustrated in FIG. 18, and then, the body 100 may be filled.

The coil patterns 300 (310, 320, 330, 340, 350, and 360) may be disposed on at least one surface of each of the plurality of bases 200, preferably, both surfaces of each of the plurality of bases 200. Here, the coil patterns 310 and 320 may be disposed on one surface and the other surface of a first substrate 200*a* and electrically connected to each other by the conductive via 210*a* provided in the first base 200*a*. Also, the coil patterns 330 and 340 may be disposed on one surface and the other surface of a second substrate 200*b* and electrically connected to each other by the conductive via 210*b* provided in the second base 200*b*. Similarly, the coil patterns 350 and 360 may be disposed on one surface and the other surface of a third substrate 200*c* and electrically connected to each other by the conductive via 210*c* provided in the third base 200*c*. Each of the plurality of coil patterns 300 may be formed in a spiral shape on a predetermined area of the base 200, e.g., outward from the through holes 220*a*, 220*b*, and 200*c* in a central portion of the base 200. The two coil patterns 310 and 320 disposed on the base 200 may be connected to each other to form one coil. That is, at least two coils may be provided in one body 100. Here, the coil patterns 310, 330, and 350 that are disposed on one side of the base 200 and the coil patterns 320, 340, and 360 that are disposed on the other side of the base 200 may have the same shape. Also, the coil patterns 300 may overlap each other on the same base 200. Alternatively, the coil patterns 320, 330, and 350 that are disposed on the one side of the base 200 may be disposed to overlap an area on which the coil patterns 320, 340, and 360 that are disposed on the other side of the base 200 are not disposed.

The external electrodes 400 (410, 420, 430, 440, 450, and 460) may be spaced apart from each other on both ends of the body 100. The external electrode 400 may be electrically connected to the coil patterns 300 respectively disposed on the plurality of bases 200. For example, the external electrodes 410 and 420 may be respectively connected to the coil patterns 310 and 320, the external electrode 430 and 440 may be respectively connected to the coil patterns 330 and 340, and the external electrodes 450 and 460 may be respectively connected to the coil patterns 350 and 360. That is, the external electrodes 400 may be respectively connected to the coil patterns 300 and 340 disposed on the bases 200*a*, 200*b*, and 200*c*.

As described above, in the power inductor according to the fourth embodiment of the present invention, the plurality of inductors may be realized in one body 100. That is, the at least two bases 200 may be arranged in the horizontal direction, and the coil patterns 300 respectively disposed on the bases 200 may be connected to each other by the external electrodes different from each other. Thus, the plurality of inductors may be disposed in parallel, and at least two power inductors may be provided in one body 100.

Figure 24:
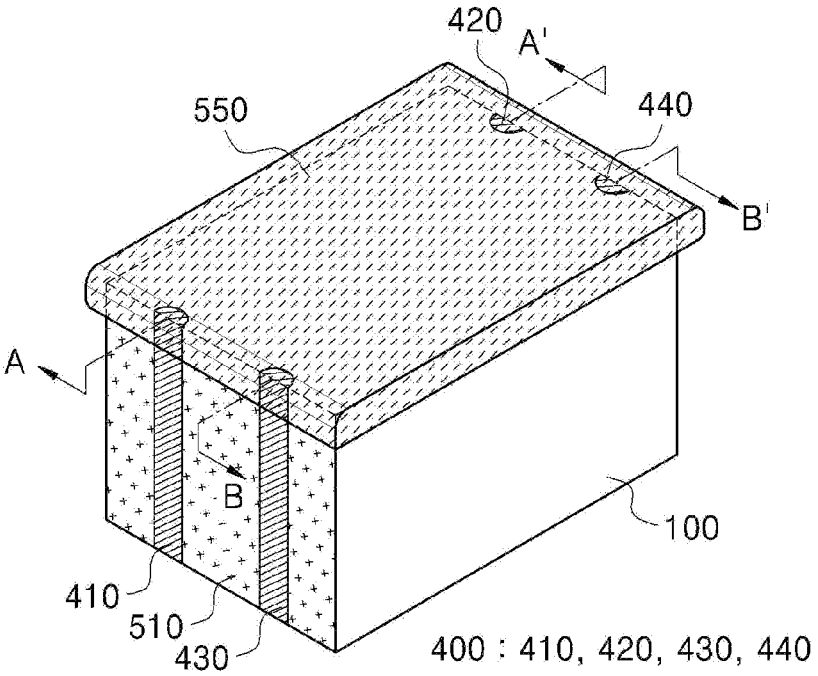
FIG. 24 is a perspective view of a power inductor in accordance with even another exemplary embodiment.
Figure 25:
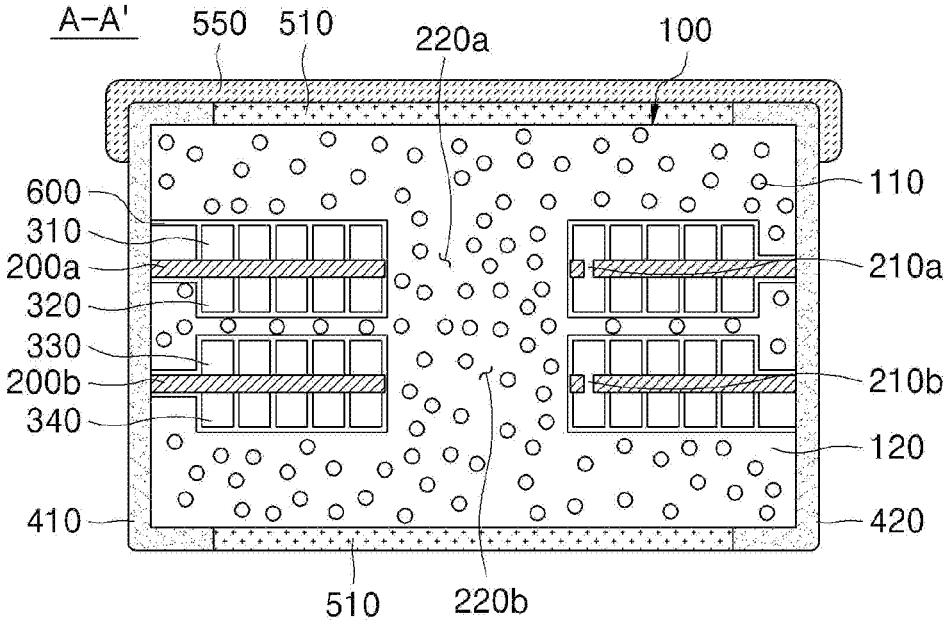
FIGS. 25 and 26 are cross-sectional views taken along lines A-A' and B-B' of FIG. 24, respectively.
Figure 26:
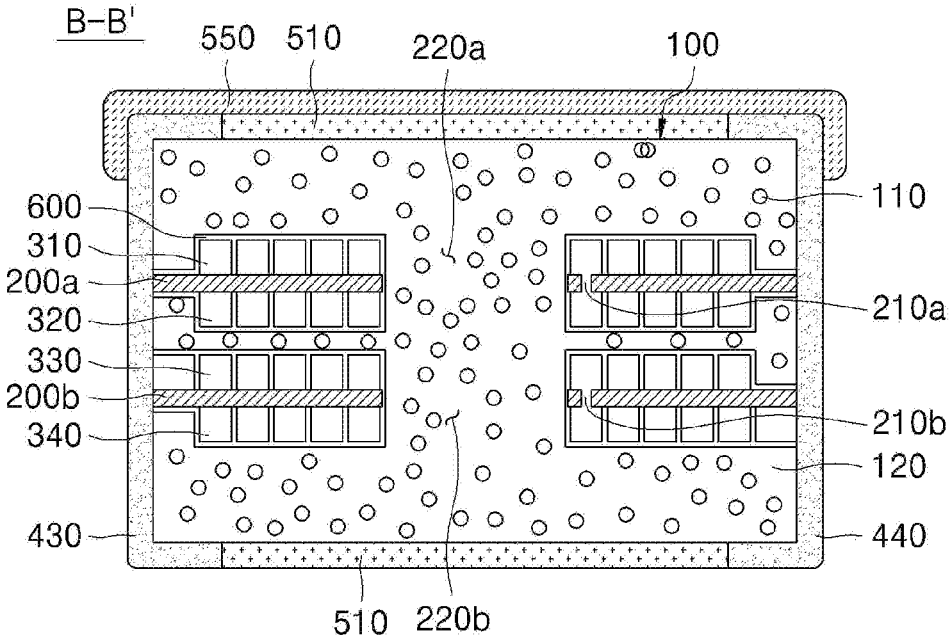

FIG. 24 is a perspective view of a power inductor in accordance with still another exemplary embodiment, and FIGS. 25 and 26 are cross-sectional views taken along lines A-A' and B-B' of FIG. 24.

Referring to FIGS. 24 to 26, a power inductor in accordance with further another exemplary embodiment may include a body 100, at least two bases 200 (200*a* and 200*b*) provided in the body 100, coil patterns 300 (310, 320, 330, and 340) disposed on at least one surface of each of the at least two bases 200, and a plurality of external electrodes 400 (410, 420, 430, and 440) disposed on two side surfaces facing of the body 100 and respectively connected to the coil patterns 310, 320, 330, and 340 disposed on the bases 200*a* and 200*b*. Here, the at least two bases 200 may be spaced a predetermined distance from each other and laminated in a thickness direction of the body 100, i.e., in a vertical direction, and the coil patterns 300 disposed on the bases 200 may be withdrawn in directions different from each other and respectively connected to the external electrodes. That is, in still another exemplary embodiment, the plurality of bases 200 may be arranged in the horizontal direction. However, in yet another exemplary embodiment, the plurality of bases may be arranged in the vertical direction. Thus, in yet another exemplary embodiment, the at least two bases 200 may be arranged in the thickness direction of the body 100, and the coil patterns 300 respectively disposed on the bases 200 may be connected to each other by the external electrodes different from each other, and thus, the plurality of inductors may be disposed in parallel, and at least two power inductors may be provided in one body 100.

As described above, in the foregoing embodiments, which are described with reference to FIGS. 15 to 26, the plurality of bases 200, on which the coil patterns 300 disposed on the at least one surface within the body 10 are disposed, may be laminated in the thickness direction (i.e., the vertical direction) of the body 100 or arranged in the direction perpendicular to (i.e., the horizontal direction) the body 100. Also, the coil patterns 300 respectively disposed on the plurality of bases 200 may be connected to the external electrodes 400 in series or parallel. That is, the coil patterns 300 respectively disposed on the plurality of bases 200 may be connected to the external electrodes 400 different from each other and arranged in parallel, and the coil patterns 300 respectively disposed on the plurality of bases 200 may be connected to the same external electrode 400 and arranged in series. When the coil patterns 300 are connected in series, the coil patterns 300 respectively disposed on the bases 200 may be connected to the connection electrodes 700 outside the body 100. Thus, when the coil patterns 300 are connected in parallel, two external electrodes 400 may be required for the plurality of bases 200. When the coil patterns 300 are connected in series, two external electrodes 400 and at least one connection electrode 700 may be required regardless of the number of bases 200. For example, when the coil patterns 300 disposed on the three bases 300 are connected to the external electrodes in parallel, six external electrodes 400 may be required. When the coil patterns 300 disposed on the three bases 300 are connected in series, two external electrodes 400 and at least one connection electrode 700 may be required. Also, when the coil patterns 300 are connected in parallel, a plurality of coils may be provided within the body 100. When the coil patterns 300 are connected in series, one coil may be provided within the body 100.

Figure 27:
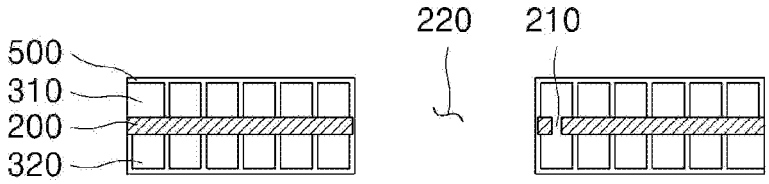
FIGS. 27 to 29 are cross-sectional views for sequentially explaining a method for manufacturing a power inductor in accordance with an exemplary embodiment.
Figure 28:
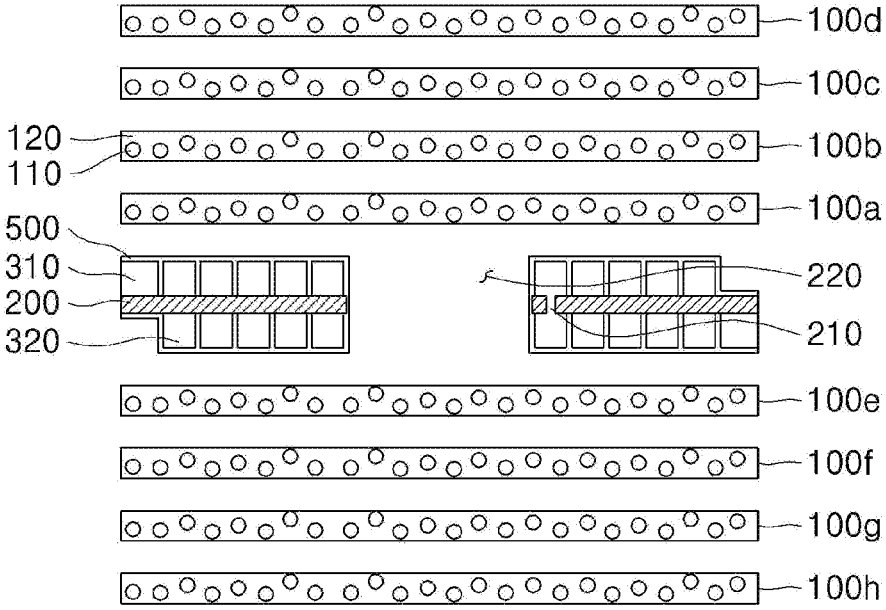
Figure 29:
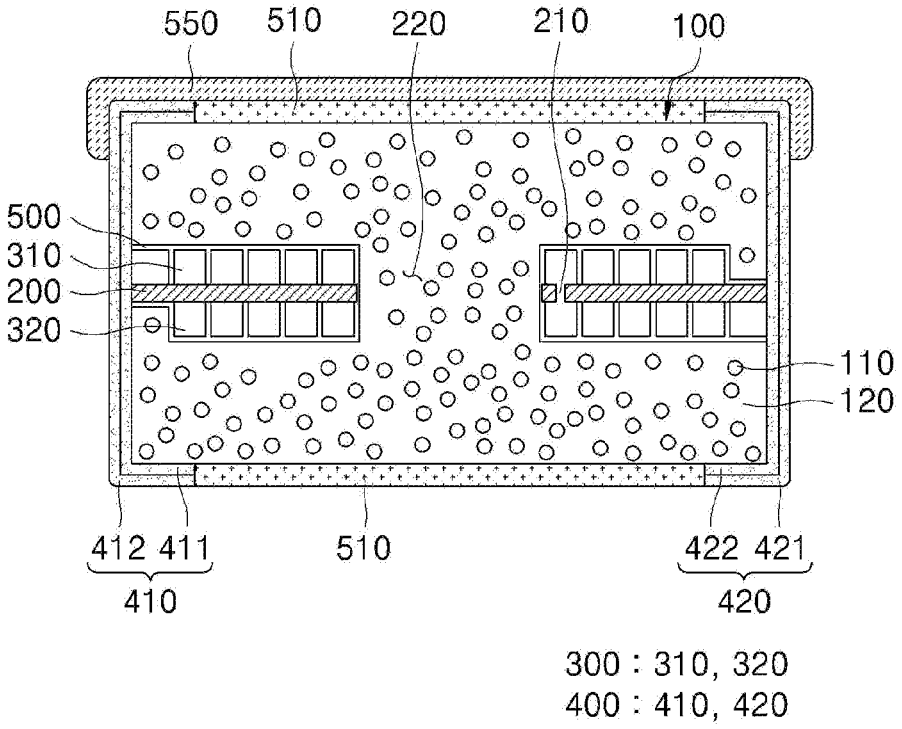

FIGS. 27 to 29 are cross-sectional views for sequentially explaining a method for manufacturing a power inductor in accordance with an exemplary embodiment.

Referring to FIG. 27, coil patterns 310 and 320 each of which has a predetermined shape may be formed on at least one surface of a base 200, i.e., one surface and the other surface of the base 200. The base 200 may be manufactured by using a CCL or metal magnetic material, preferably, a metal magnetic material that is capable of increasing effective magnetic permeability and facilitating relation of capacity. The base 200 may be manufactured by using a CCL or metal magnetic material, preferably, a metal magnetic material that is capable of increasing effective magnetic permeability and facilitating relation of capacity. Here, a through hole 220 may be formed in a central portion of the base 200, and a conductive via 201 may be formed in a predetermined region of the base 200. Also, the base 200 may have a shape in which an outer region except for the through hole 220 is removed. For example, the through hole 220 may be formed in a central portion of the base having a rectangular shape with a predetermined thickness, and the conductive via 210 may be formed in the predetermined region. Here, at least a portion of the outside of the base 200 may be removed. Here, the removed portion of the base 200 may be outer portions of the coil patterns 310 and 320 formed in a spiral shape. Also, the coil patterns 310 and 320 may be formed on a predetermined area of the base 200, e.g., in a circular spiral shape from the central portion. Here, the coil pattern 310 may be formed on one surface of the base 20, and a conductive via 210 passing through a predetermined region of the base 200 and filled with a conductive material may be formed. Then, the coil pattern 320 may be formed on the other surface of the base 200. The conductive via 210 may be formed by filling conductive paste into a via hole after the via hole is formed in a thickness direction of the base 200 by using laser. Also, the coil pattern 310 may be formed through, for example, a plating process. For this, a photosensitive pattern may be formed on one surface of the base 200, and the plating process using the copper foil on the base 200 as a seed may be performed to grow a metal layer from a surface of the exposed base 200. Then, the photosensitive film may be reduced to form the coil pattern 310. Also, the coil pattern 320 may be formed on the other surface of the base 200 through the same method as the coil pattern 310. The coil patterns 310 and 320 may be formed with a multilayer structure. When the coil patterns 310 and 320 have the multilayer structure, the insulation layer may be disposed between a lower layer and an upper layer. Then, a second conductive via (not shown) may be formed in the insulation layer to connect the multilayered coil patterns to each other. As described above, the coil patterns 310 and 320 may be formed on the one surface and the other surface of the base 20, and then, an internal insulation layer 500 may be formed to cover the coil patterns 310 and 320. Also, the coil patterns 310 and 320 may be formed by applying an insulation polymer material such as parylene. Preferably, the internal insulation layer 500 may be formed on top and side surfaces of the base 200 as well as top and side surfaces of the coil patterns 310 and 320 because of being coated with the parylene. Here, the internal insulation layer 500 may be formed on the top and side surfaces of the coil patterns 310 and 320 and the top and side surfaces of the base 200 at the same thickness. That is, the base 200 on which the coil patterns 310 and 320 are formed may be provided in a deposition chamber, and then, the parylene may be evaporated and supplied into the vacuum chamber to deposit the parylene on the coil patterns 310 and 320 and the base 200. For example, the parylene may be primarily heated and evaporated in a vaporizer to become a dimer state and then be secondarily heated and pyrolyzed into a monomer state. Then, when the parylene is cooled by using a cold trap connected to the deposition chamber and a mechanical vacuum pump, the parylene may be converted from the monomer state to a polymer state and thus be deposited on the coil patterns 310 and 320. Here, a primary heating process for forming the dimer state by evaporating the parylene may be performed at a temperature of 100° C. to 200° C. and a pressure of 1.0 Torr. A secondary heating process for forming the monomer state by pyrolyzing the evaporated parylene may be performed at a temperature of 400° C. to 500° C. degrees and a pressure of 0.5 Torr. Also, the deposition chamber for depositing the parylene in a state of changing the monomer state into the polymer state may be maintained at a temperature of 25° C. and a pressure of 0.1 Torr. Since the parylene is applied to the coil patterns 310 and 320, the internal insulation layer 500 may be applied along a stepped portion between each of the coil patterns 310 and 320 and the base 200, and thus, the internal insulation layer 500 may be formed with the uniform thickness. Alternatively, the internal insulation layer 500 may be formed by closely attaching a sheet including at least one material selected from the group consisting of epoxy, polyimide, and liquid crystal crystalline polymer to the coil patterns 310 and 320.

Referring to FIG. 28, a plurality of sheets 100*a* to 100*h* made of a material including the metal powder 110 and the insulation material 120 and further including the thermal conductive filler 130 are provided. Here, the metal powder 110 may use a metal material including iron (Fe), and the insulation material 120 may use an epoxy and polyimide, which are capable of insulating the metal powder 110 from each other. The thermal conductive filler may use MgO, AlN, and carbon-based materials, which are capable of releasing the heat of the metal powder 110 to the outside. Also, a surface of the metal powder 110 may be coated with the magnetic material, for example, a metal oxide magnetic material or coated with an insulation material such as parylene. Here, the insulation material 120 may be contained at a content of 2.0 wt % to 5.0 wt % with respect to 100 wt % of the metal powder 110, and the thermal conductive filler may be contained at a content of 0.5 wt % to 3 wt % with respect to 100 wt % of the metal powder 110. The plurality of sheets 100*a* to 100*h* are disposed on upper and lower portions of the base 200 on which the coil patterns 310 and 320 are formed, respectively. The plurality of sheets 100*a* to 100*h* may have contents of the thermal conductive filler, which are different from each other. For example, the content of the thermal conductive filler may gradually increase upward and downward from the one surface and the other surface of the base 200. That is, the thermal conductive filler of each of the sheets 100*b* and 100*e*, which are disposed above and below the sheets 100*a* and 100*d* contacting the base 200, may have a content greater than that of the thermal conductive filler of each of the sheets 100*a* and 100*d*, and the thermal conductive filler 130 of each of the sheets 100*c* and 100*f*, which are disposed above and below the sheets 100*b* and 100*e*, may have a content greater than that of the thermal conductive filler of each of the sheets 100*b* and 100*e*. Since the content of the thermal conductive filler increases in a direction that is away from the base 200, thermal transfer efficiency may be more improved. Also, as proposed in another embodiment of the present invention, first and second magnetic layers 610 and 620 may be respectively disposed on top and bottom surfaces of the uppermost and lowermost sheets 100*a* and 100*h*. Each of the first and second magnetic layers 610 and 620 may be manufactured by using a material having magnetic permeability greater than that of each of the sheets 100*a* to 100*h*. For example, each of the first and second magnetic layers 610 and 620 may be manufactured by using magnetic powder and an epoxy resin so that the first and second magnetic layers 610 and 620 have magnetic permeability greater than those of the sheets 100*a* to 100*h*. Also, a thermal conductive filler may be further provided in each of the first and second magnetic layers 610 and 620.

Referring to FIG. 29, the plurality of sheets 100*a* to 100*h*, which are alternately disposed with the base 200 therebetween, may be laminated and compressed and then molded to form the body 100. As a result, the body 100 may be filled into the through hole 220 of the base 200 and the removed portion of the base 200. Also, although not shown, each of the body 100 and the base 200 may be cut into a unit of a unit device, and then the external electrode 400 electrically connected to the withdrawn portion of each of the coil patterns 310 and 320 may be formed on both ends of the body 100. At least a portion of the external electrode 400 may be formed of the same material as the coil pattern 300 and in the same manner as the coil pattern 300. That is, the first layers 411 and 421 may be formed through the electroless plating and the electrolytic plating using copper, and at least one layer of the second layers 412 and 422 may be formed through the plating method using Ni, Sn, and the like. Here, the external electrode 400 may be formed by using the coil pattern 300 exposed to the outside of the body 100 as a seed. As described above, at least a portion of the external electrode 400 may be formed through the copper plating to improve the coupling force of the external electrode 400. Here, the coupling force between the coil pattern 300 and the external electrode 400 may be greater than that between the body 100 and the external electrode 400. Also, the capping insulation layer 550 may be formed to prevent the extending external electrode 400 formed on the top surface of the body 100 from being exposed.

The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims.

The invention claimed is:

1. A power inductor comprising:

a body comprising metal powder and an insulation material;

at least one base provided in the body and having a plate shape with a first surface and a second surface;

at least one coil pattern disposed on at least one surface of the base, the at least one surface selected from the group consisting of the first surface and the second surface; and an external electrode disposed on each of at least two side surfaces of the body, wherein the coil pattern comprises:

a first plating layer disposed on the at least one surface of the base and having a side surface inclined by a predetermined angle from an outer side of the base; and a second plating layer disposed to cover the first plating layer such that the first plating layer is disposed between the base and the second plating layer, the second plating layer having a rounded area between a top surface and a side surface thereof and wherein the side surface of the second plating layer is perpendicular to the outer side of the base, wherein a ratio between a width of a bottom surface of the first plating layer and a width of a bottom surface of the second plating layer is 1:1.2 to 1:2, and a ratio between a width of the top surface of the second plating layer except for the rounded area and a width of the bottom surface of the second plating layer is 0.6:1 to 0.8:1.

2. The power inductor of claim 1, wherein each of the coil pattern and the external electrode comprises copper.

3. The power inductor of claim 1, wherein the coil pattern is formed on the base through a plating process, and an area of the external electrode, which comes into contact with at least the coil pattern, is formed through the plating process.

4. The power inductor of claim 3, wherein the external electrode comprises a first layer coming into contact with the coil pattern and at least one second layer made of a material different from that of the first layer.

5. The power inductor of claim 1, wherein the metal powder comprises at least one or more materials having at least two or more sizes.

6. The power inductor of claim 1, wherein the at least one coil pattern includes a first coil pattern disposed on the first surface of the base and a second coil pattern disposed on the second surface of the base, wherein the first coil pattern and the second coil pattern have the same height, which is greater 2.5 times than a thickness of the base.

7. The power inductor of claim 1, further comprising an internal insulation layer disposed between the coil pattern and the body and made of parylene.

8. The power inductor of claim 1, further comprising a surface insulation layer disposed on at least one surface of the body.

9. The power inductor of claim 8, wherein the surface insulation layer is disposed on that at least one surface of the body, on which the external electrode is not disposed.

10. The power inductor of claim 1, further comprising a capping insulation layer on one surface of the body.

11. The power inductor of claim 10, wherein the capping insulation layer is disposed on one surface facing a mounted surface of the body to prevent the external electrode disposed on the one surface from being exposed.

12. The power inductor of claim 10, wherein the capping insulation layer has a thickness greater than or equal to that of the surface capping insulation layer.

13. The power inductor of claim 1, wherein the second plating layer has an approximately rectangular shape.

* * * * *